US010590895B2

(12) United States Patent
Matsumiya et al.

(10) Patent No.: US 10,590,895 B2
(45) Date of Patent: Mar. 17, 2020

(54) WORK MACHINE

(71) Applicant: KUBOTA CORPORATION, Osaka-shi (JP)

(72) Inventors: Daisuke Matsumiya, Sakai (JP); Takashi Miura, Sakai (JP); Shintaro Nakabayashi, Sakai (JP); Shoichi Kawano, Sakai (JP); Yoshiaki Araki, Sakai (JP)

(73) Assignee: KUBOTA CORPORATION, Osaka-Shi (JP)

( * ) Notice: Subject to any disclaimer, the term of this patent is extended or adjusted under 35 U.S.C. 154(b) by 258 days.

(21) Appl. No.: 15/627,354

(22) Filed: Jun. 19, 2017

(65) Prior Publication Data

US 2018/0087478 A1 Mar. 29, 2018

(30) Foreign Application Priority Data

Sep. 29, 2016 (JP) ..... 2016-191128

(51) Int. Cl.
*F02M 37/22* (2019.01)
*F02M 55/02* (2006.01)
(Continued)

(52) U.S. Cl.
CPC ..... *F02M 37/24* (2019.01); *E02F 9/0883* (2013.01); *E02F 9/10* (2013.01); *E02F 9/18* (2013.01); *F02M 37/007* (2013.01); *F02M 37/0047* (2013.01); *F02M 37/0052* (2013.01); *F02M 37/04* (2013.01); *F02M 37/22* (2013.01);
(Continued)

(58) Field of Classification Search
CPC ..... B01D 35/005; B01D 35/26; E02F 3/32; E02F 3/964; E02F 9/0883; E02F 9/0891; E02F 9/10; E02F 9/18; F02M 35/164; F02M 37/0047; F02M 37/0052; F02M 37/007; F02M 37/04; F02M 37/22; F02M 37/24; F02M 37/30; F02M 55/025
See application file for complete search history.

(56) References Cited

U.S. PATENT DOCUMENTS 5,355,860 A 10/1994 Ekstam
2006/0157393 A1* 7/2006 Jones ..... B01D 35/18 210/104
(Continued)

FOREIGN PATENT DOCUMENTS

CN 202300751 U 7/2012
JP 57-000070 U 5/1980
(Continued)

OTHER PUBLICATIONS

Extended European Search Report for corresponding EP Application No. 17177097.7-1616, dated Nov. 20, 2017.
(Continued)

*Primary Examiner* — Pranav N Patel
(74) *Attorney, Agent, or Firm* — Mori & Ward, LLP

(57) ABSTRACT

A work machine includes an engine, a fluid path via which a fuel oil is supplied to the engine, a first filter provided in the fluid path, a pump provided between the engine and the first filter in the fluid path to suck and output the fuel oil, a second filter provided between the engine and the pump in the fluid path, and a third filter provided between the engine and the second filter in the fluid path.

10 Claims, 18 Drawing Sheets

(51) Int. Cl.

| | |
|---|---|
| ***E02F 9/10*** | (2006.01) |
| ***F02M 37/24*** | (2019.01) |
| ***F02M 37/30*** | (2019.01) |
| ***F02M 37/00*** | (2006.01) |
| ***F02M 37/04*** | (2006.01) |
| ***E02F 9/08*** | (2006.01) |
| ***E02F 9/18*** | (2006.01) |
| *F02M 35/16* | (2006.01) |
| *E02F 3/32* | (2006.01) |
| *E02F 3/96* | (2006.01) |

(52) U.S. Cl.

CPC ..... *F02M 37/30* (2019.01); *F02M 55/025* (2013.01); *E02F 3/32* (2013.01); *E02F 3/964* (2013.01); *E02F 9/0891* (2013.01); *F02M 35/164* (2013.01)

(56) References Cited

U.S. PATENT DOCUMENTS

| | | | | |
|---|---|---|---|---|
| 2008/0035555 | A1 | 2/2008 | Blizard et al. | |
| 2009/0145402 | A1 | 6/2009 | Sano | |
| 2009/0145823 | A1* | 6/2009 | Lauer | B01D 17/10 210/104 |
| 2012/0067658 | A1* | 3/2012 | Ueda | B60H 1/00378 180/291 |
| 2013/0240066 | A1* | 9/2013 | Ono | F02M 37/22 137/565.01 |
| 2013/0312706 | A1 | 11/2013 | Salvador et al. | |
| 2016/0177899 | A1 | 6/2016 | Ross et al. | |

FOREIGN PATENT DOCUMENTS

| | | |
|---|---|---|
| JP | 59-041667 U | 3/1984 |
| JP | 62-277115 | 12/1987 |
| JP | 02-061361 | 3/1990 |
| JP | 2007-162624 | 6/2007 |
| JP | 2014-008940 | 1/2014 |
| WO | WO 2013/008064 | 1/2013 |

OTHER PUBLICATIONS

European Office Action for corresponding EP Application No. 17177097.7-1004, dated Nov. 8, 2018.

* cited by examiner

WORK MACHINE

CROSS-REFERENCE TO RELATED APPLICATIONS

The present application claims priority under 35 U.S.C. § 119 to Japanese Patent Application No. 2016-191128, filed Sep. 29, 2016. The contents of this application are incorporated herein by reference in their entirety.

BACKGROUND OF THE INVENTION

Field of the Invention

The present invention relates to a work machine.

Discussion of the Background

Japanese Unexamined Patent Application Publication No. 2007-162624 discloses a work machine having a filter for filtrating fuel oil.

The work machine disclosed in Japanese Unexamined Patent Application Publication No. 2007-162624 includes a pre-filter and a main filter each disposed on a pipe configured to supply fuel oil to an engine, the fuel oil being stored in a fuel tank. The pre-filter and the main filter remove impurities flowing in the pipe. In particular, Japanese Unexamined Patent Application Publication No. 2007-162624 discloses the technique that arranges an electromagnetic pump on an upper stream than the main filter and that arranges the pre-filter on an upper stream than the electromagnetic pump, the pre-filter having both of a function for separating the water and a function for removing the impurities. In this manner, the electromagnetic pump is prevented from being damaged by the impurities in the fuel oil.

SUMMARY OF THE INVENTION

According to one aspect of the present invention, a work machine includes an engine, a fluid path via which a fuel oil is supplied to the engine, a first filter provided in the fluid path, a pump provided between the engine and the first filter in the fluid path to suck and output the fuel oil, the pump provided between the engine and the first filter in the fluid path, a second filter provided between the engine and the pump in the fluid path, and a third filter provided between the engine and the second filter in the fluid path.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
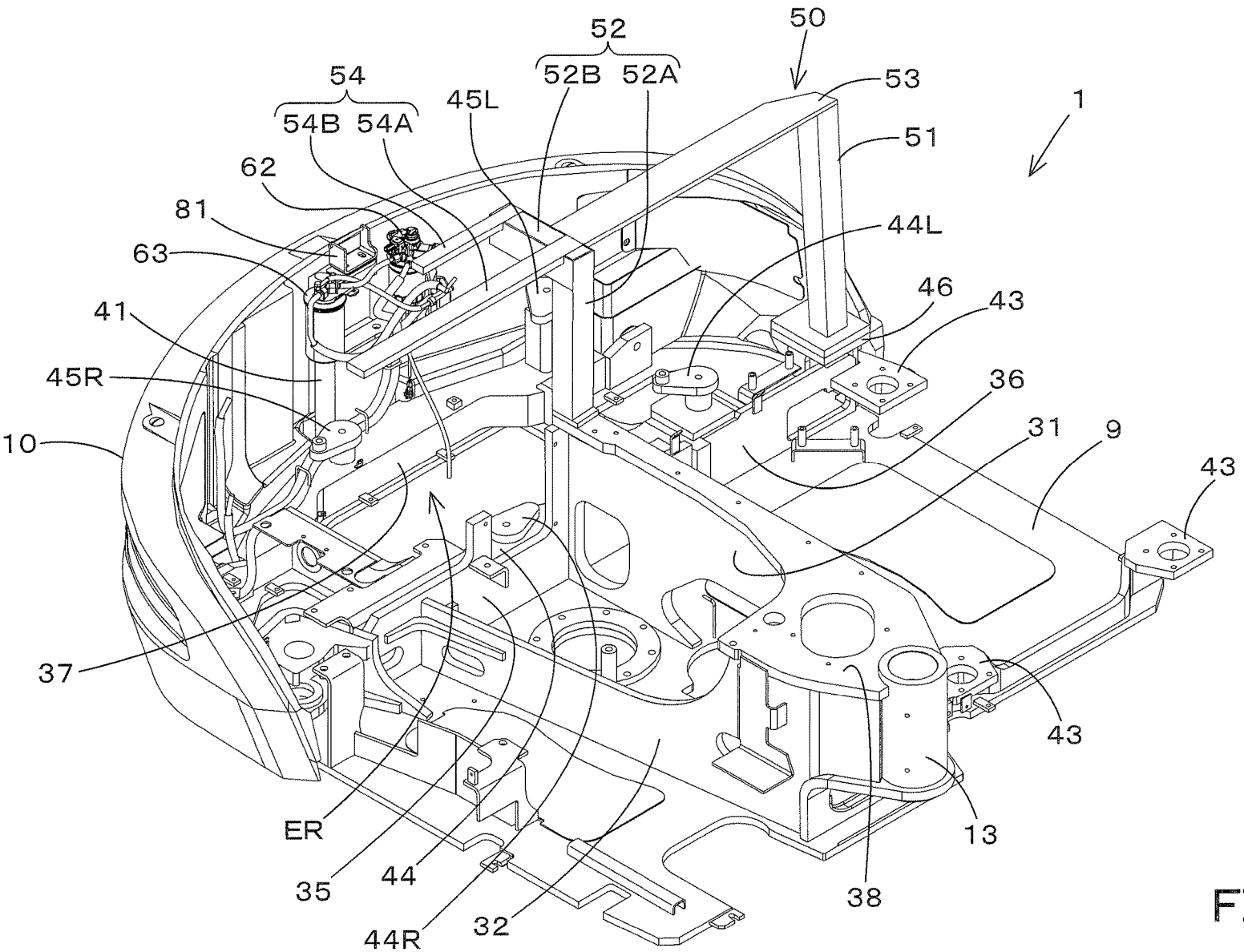
FIG. 1 is a perspective view illustrating a major configuration (a base plate, a weight, a second filter, a third filter, and the like) of a work machine according to a first embodiment of the present invention.
Figure 2:
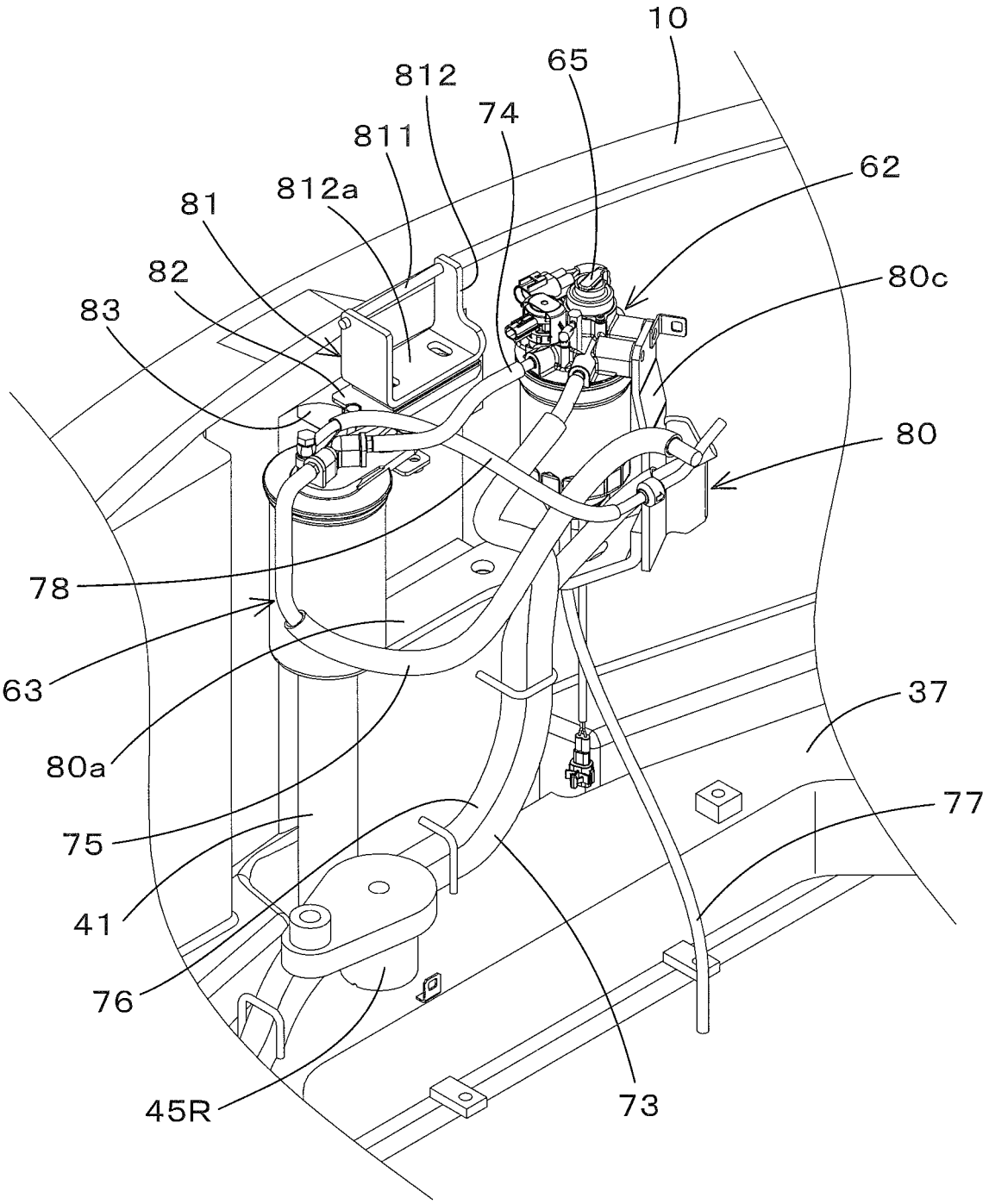
FIG. 2 is a perspective view illustrating a portion around the second filter and the third filter of the work machine according to the first embodiment.

The embodiment will now be described with reference to the accompanying drawings, wherein like reference numerals designate corresponding or identical elements throughout the various drawings. The drawings are to be viewed in an orientation in which the reference numerals are viewed correctly.

Referring to drawings, embodiments of the present invention will be explained below.

First Embodiment

Whole Configuration

Figure 16:
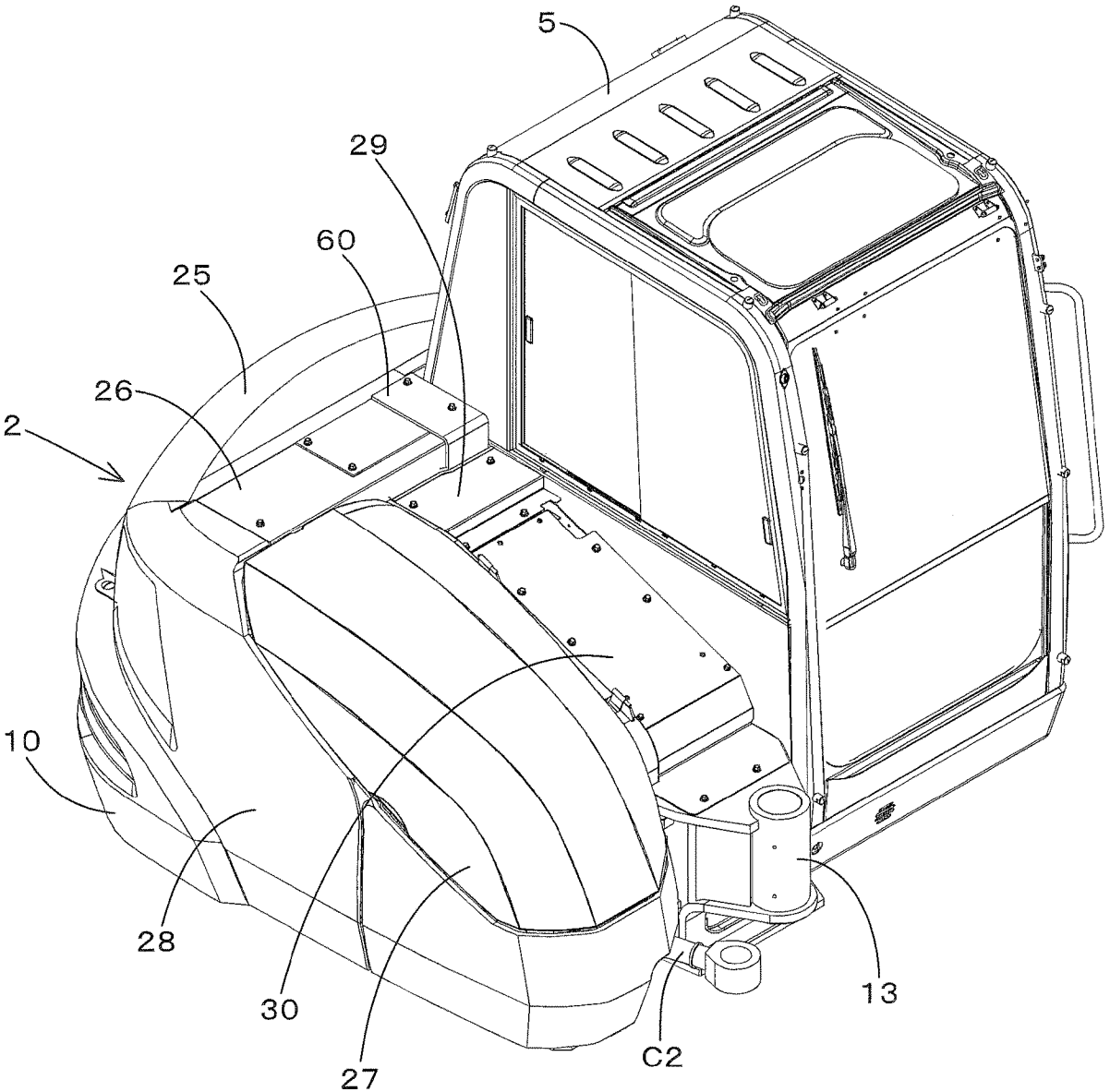
FIG. 16 is a perspective view illustrating the work machine (omitting a travel device and an operation device) according to the embodiments of the present invention.
Figure 17:
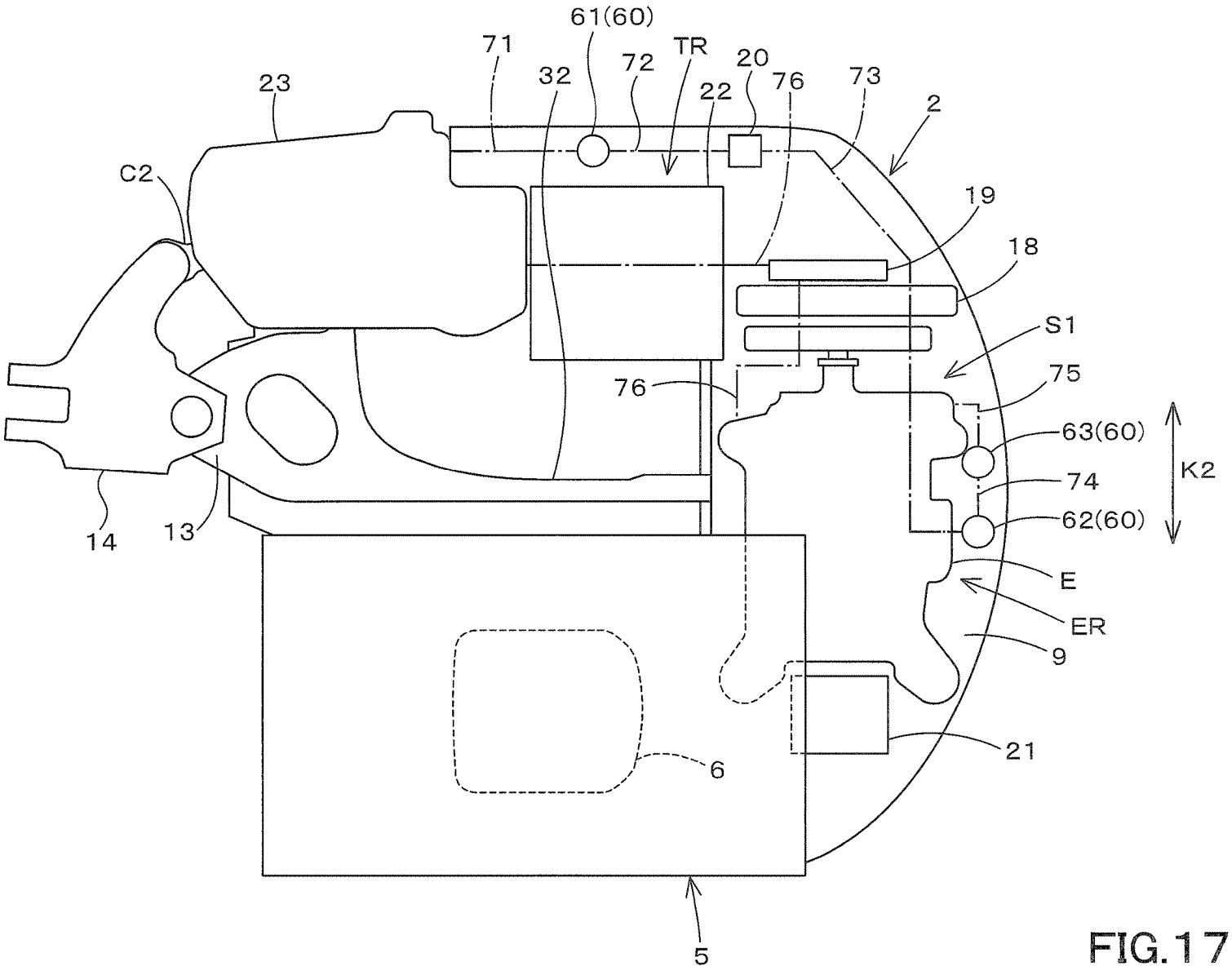
FIG. 17 is a schematic plan view illustrating the work machine (omitting the travel device and the operation device) according to the embodiments.
Figure 18:
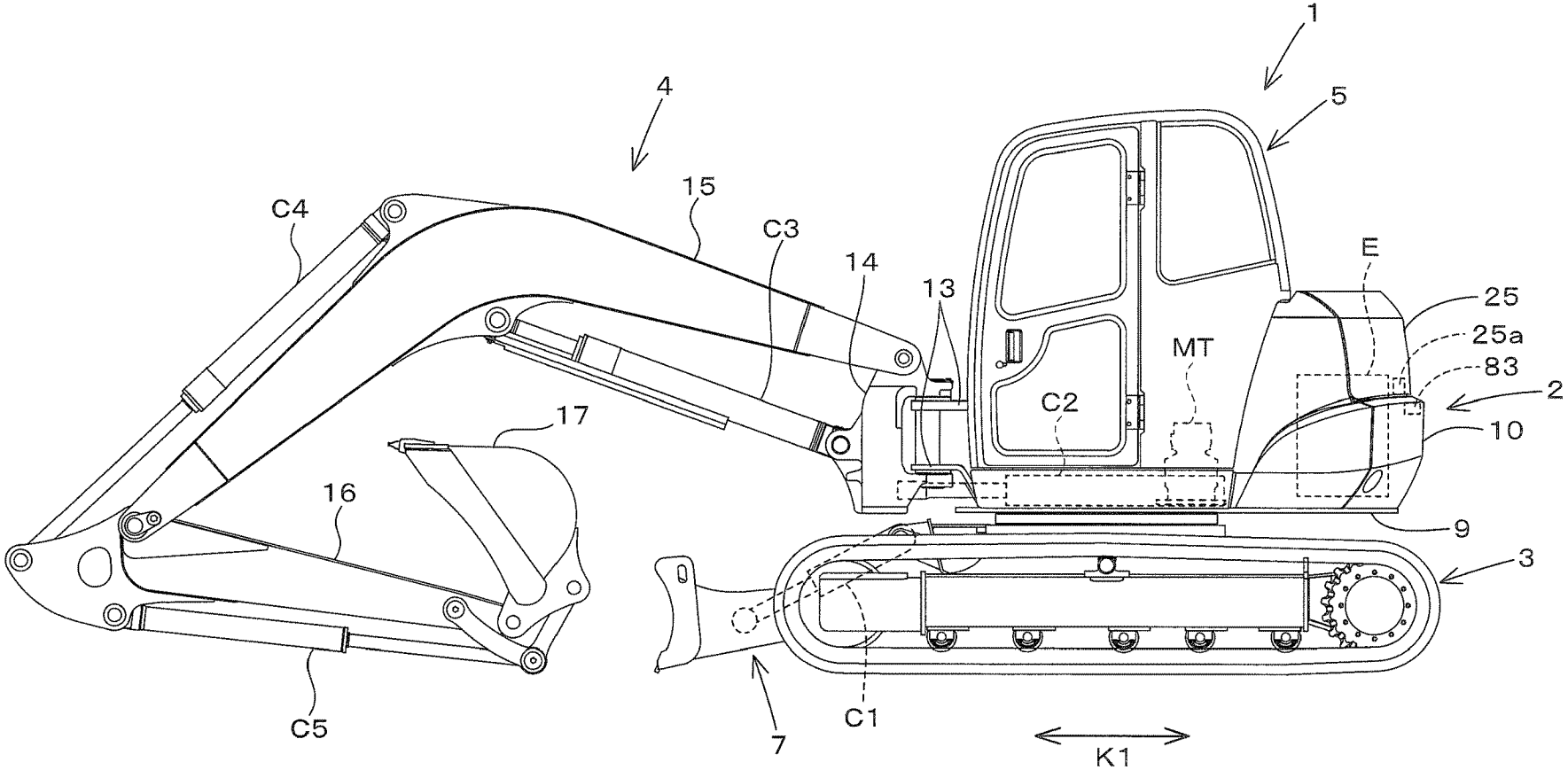
FIG. 18 is a side view illustrating the work machine according to the embodiments.

FIG. 16 to FIG. 18 illustrate a work machine 1 according to one embodiment (a first embodiment) of the present invention. The embodiment exemplifies a backhoe as the work machine 1. The backhoe is a swiveling work machine (or a turning work machine). However, the work machine 1 is not limited only to the backhoe but may be other work machines such as a tractor, a loader work machine (a compact track loader and the like).

The work machine 1 includes a machine body (a turning base) 2, a travel device 3, and an operation device 4.

A cabin 5 is mounted on the machine body 2. As shown in FIG. 17, an operator seat 6 is arranged in the cabin 5. Hereinafter, in explanations of all the embodiments of the present invention, a forward direction (a direction shown by an arrowed line F in FIG. 18) corresponds to a front side of an operator seating on an operator seat 6 of the work machine 1, a backward direction (a direction shown by an arrowed line R in FIG. 18) corresponds to a back side of the operator, a leftward direction (a direction vertically extending from a back surface to a front surface of FIG. 18) corresponds to a left side of the operator, and a rightward direction (a direction vertically extending from the front surface to the back surface of FIG. 18) corresponds to a right side of the operator.

In addition, a machine width direction corresponds to a horizontal direction K2 (refer to FIG. 17) perpendicular to a front to rear direction K1.

The travel device 3 is disposed on a lower portion of the machine body 2. In the embodiment, the travel device 3 is constituted of a crawler-type travel device. However, the travel device 3 may be a wheel-type travel device having a front wheel and a rear wheel. A dozer device 7 is attached to a front portion of the travel device 3. A dozer cylinder C1 is capable of being stretched and shortened. The dozer device 7 is moved upward and downward by the stretching and shortening of the dozer cylinder C1.

The machine body 2 is supported on the travel device 3 by a turn bearing. Thus, the machine body 2 is capable of being turned about a perpendicular axis (a vertical axis) of the turn bearing. The machine body 2 is turned by a turn motor MT. The machine body 2 includes a base plate (a turn base plate) 9 and a weight 10. The base plate 9 is configured to turn about the vertical axis. The weight 10 is arranged to balance the weight of the work machine 1 against the operation device 4. The weight 10 is disposed on the rear portion of the machine body 2.

A support bracket 13 is included on the front portion of the machine body 2. A swing bracket 14 is attached to the support bracket 13. Thus, the swing bracket 14 is capable of being swung about the vertical axis. The operation device 4 is attached to the swing bracket 14.

The operation device 4 includes a boom 15, an arm 16, and a bucket 17. A base portion of the boom 15 is pivotally attached to the swing bracket 14. Thus, the base portion of the boom 15 is capable of being turned about a horizontal axis, and thereby the boom 15 is capable of being swung upward and downward. The arm 16 is pivotally attached to a tip end portion of the boom 15. Thus, the arm 16 is capable of being turned about the horizontal axis and thereby being swung forward and backward. The bucket 17 is disposed on a tip end portion of the arm 16. Thus, the bucket 17 is capable of shoveling and dumping.

A swing cylinder C2 is capable of being stretched and shortened. The swing bracket 14 is swung by the stretching and shortening of the swing cylinder C2. A boom cylinder C3 is capable of being stretched and shortened. The boom 15 is swung by the stretching and shortening of the boom cylinder C3. An arm cylinder C4 is capable of being stretched and shortened. The arm 16 is swung by the stretching and shortening of the aim cylinder C4. A bucket cylinder C5 is capable of being stretched and shortened. The bucket 17 shovels and dumps due to the stretching and shortening of the bucket cylinder C5.

As shown in FIG. 17, an engine room ER is disposed on the rear portion of the machine body 2. An engine E is arranged in the engine room ER. The engine E is a diesel engine, for example, a diesel engine (a common-rail type engine) having a common-rail fuel injection system (CRS).

The common-rail type engine includes a fuel pressuring-supplying pump (a supply pump), a common-rail (a pressure accumulation chamber), and an injector. The fuel pressuring-supplying pump generates a highly-pressured fuel. The common-rail accumulates the highly-pressured fuel generated by the fuel pump. The injector injects the highly-pressured fuel to each of cylinders of the engine E under the control by an ECU, the highly-pressured fuel being accumulated in the common-rail.

A radiator 18, a fuel oil cooler 19, and a fuel pump 20 are arranged on the right side of the engine E. A hydraulic pump 21 is arranged on the left side of the engine E.

A tank room TR is disposed on a right portion of the machine body 2. An operation fluid tank 22 is arranged in the tank room TR. The operation fluid tank 22 stores the operation fluid that is to be supplied to the hydraulic devices. The operation fluid stored in the operation fluid tank 22 is supplied to the hydraulic devices by the hydraulic pump 21.

A fuel tank 23 is arranged in front of the operation fluid tank 22. The fuel tank 23 stores the fuel oil that is to be supplied to the engine E. The fuel oil stored in the fuel tank 23 is supplied to the engine E by the fuel pump 20.

A first filter 61 is arranged in the vicinity of the operation fluid tank 22. A second filter 62 and a third filter 63 are arranged behind the engine E. The first filter 61, the second filter 62, and the third filter 63 constitute a fuel filtration device 60. The fuel filtration device 60 will be explained below.

As shown in FIG. 16, an upper portion of the machine body 2 is covered with a cover. The cover includes a first cover 25, a second cover 26, a third cover 27, a fourth cover 28, a fifth cover 29, and a sixth cover 30.

The first cover 25 covers an upper surface of the rear portion of the engine room ER. Hereinafter, the first cover 25 is referred to as "the bonnet 25". The bonnet 25 is capable of being opened and closed turning about a support shaft (described later) disposed in front of the bonnet 25, and thus covers the upper surface of the engine E when the bonnet 25 is closed.

As shown in FIG. 18, a latch 25*a* is attached to a rear lower portion of the bonnet 25. The latch 25*a* is latched to a receiving shaft 811 of a first bracket 81 when the bonnet 25 is closed. The first bracket 81 will be described later. The second cover 26 covers an upper surface of a right front portion of the engine room ER. The third cover 27 covers an upper surface of the tank room TR.

The fourth cover 28 covers a right side surface of the tank room TR. The fifth cover 29 is disposed between the cabin 5 and the third cover 27. The sixth cover 30 is disposed in front of the fifth cover 29.

As shown in FIG. 1, an upper structural body is disposed on the base plate 9. The upper structural body includes vertical ribs (a first vertical rib 31 and a second vertical rib 32), partition plates (a first partition plate 35 and a second partition plate 36), a rear portion frame 37, and a rear support member 41. The upper structural body is integrated with the base plate 9 by the welding, and thus the upper structural body and the base plate 9 constitute a turn frame.

The first vertical rib 31 extends backward from the front on the base plate 9, the first vertical rib 31 passing through a turn center of the machine body 3. The second vertical rib 32 extends backward from the front on the base plate 9, the second vertical rib 32 being arranged to the right of the first vertical rib 31. The support bracket 13 is disposed between a front portion of the first vertical rib 31 and a front portion of the second vertical rib 32. A support plate 38 bridges a space between an upper portion of the first vertical rib 31 and an upper portion of the second vertical rib 32.

The first partition plate 35 is arranged in front of the engine room ER, and the first partition plate 35 extends toward the machine width direction. The second partition plate 36 extends leftward from the left side of the first partition plate 35. The rear portion frame 37 is disposed on a rear portion of the base plate 9 and extends in the machine width direction.

The rear support member 41 stands at a center of the rear portion of the base plate 9 in the machine width direction. The rear support member 41 is connected to a rear portion of the rear portion frame 37. The weight 10 is attached by fastening members (bolts) to the rear portion of the rear portion frame 37 and to a rear portion of the rear support member 41.

The upper structural body further includes a cabin support member 43, a lateral plate 44, support stays 45R and 45L, and a left support member 46.

The cabin support member 43 supports the cabin 3 with a mount member (an anti-vibration rubber and the like) sandwiched between the cabin 3 and the cabin support member 43. The lateral plate 44 is connected to a rear surface of the first partition plate 35. The lateral plate includes a right support portion 44R and a left support portion 44L. The right support portion 44R and the left support portion 44L supports a front portion of the engine E with a mount member sandwiched between the engine E and the right support portion 44R and the left support portion 44L. The support stay 45R stands on a right upper portion of the rear portion frame 37.

The support stay 45L stands on a left upper portion of the rear portion frame 37. The support stay 45R and the support stay 45L support a rear portion of the engine E with a mount member sandwiched between the engine E and the support stays 45R and 45L. The left support member 46 is disposed on a left portion of the base plate 9. The left support member 46 is connected to a left portion of the second partition plate 36. The left support member 46 supports a leg 51 (a first leg 51) of a support frame 50. The support frame 50 will be explained below.

The support frame 50 is disposed on the base plate 9. The support frame 50 supports the covers mentioned above (the first cover (the bonnet) 25 to the sixth cover 30). The support frame 50 includes the leg 51, a leg 52 (a second leg 52), a first support portion 53, and a second support portion 54.

The leg 51 (the first leg 51) stands on one of sides (on the left side) of the base plate 9 in a width direction of the base plate 9 (the width direction being identical to the machine width direction). The leg 52 (the second leg 52) stands to the right of the leg 51.

The leg 52 includes a support pole 52A and a communicating portion 52B. A lower portion of the support pole 52A is fixed by a bolt to a rear portion of an upper surface of the support plate 38. The lower portion of the support pole 52A extends upward from the upper surface of the support plate 38. The communicating portion 52B is disposed on the support pole 52A and extends backward from an upper portion of the support pole 52A.

The first support portion 53 is disposed on one of sides (on the left side) of the base plate 9 in the width direction of the base plate 9. The first support portion 53 extends along the machine width direction, and connects an upper portion of the leg 51 to an upper portion of the leg 52. The first support portion 53 supports the rear portion of the cabin 3 with a mount member (an anti-vibration rubber and the like) sandwiched between the cabin 3 and the first support member 53.

The second support portion 54 is disposed on the other one of the sides (on the right side) of the base plate 9 in the width direction of the base plate 9. The second support portion 54 supports the second cover 26. The second support portion 54 includes a front member 54A and a rear member 54B. The front member 54A extends from the communicating portion 52B toward the machine width direction (the right direction). The rear member 54B extends from the communicating portion 52B toward the machine width direction (the right direction).

A support shaft (not shown in the drawings) is disposed on a rear portion of the first support portion 53 and on a rear portion of the second support portion 54 (the rear member 54B). A front portion of the bonnet 25 is attached to the support shaft. The bonnet 25 turns about an axis of the support shaft, and thereby is capable of being opened and closed.

Fuel Filtration Device

Figure 8:
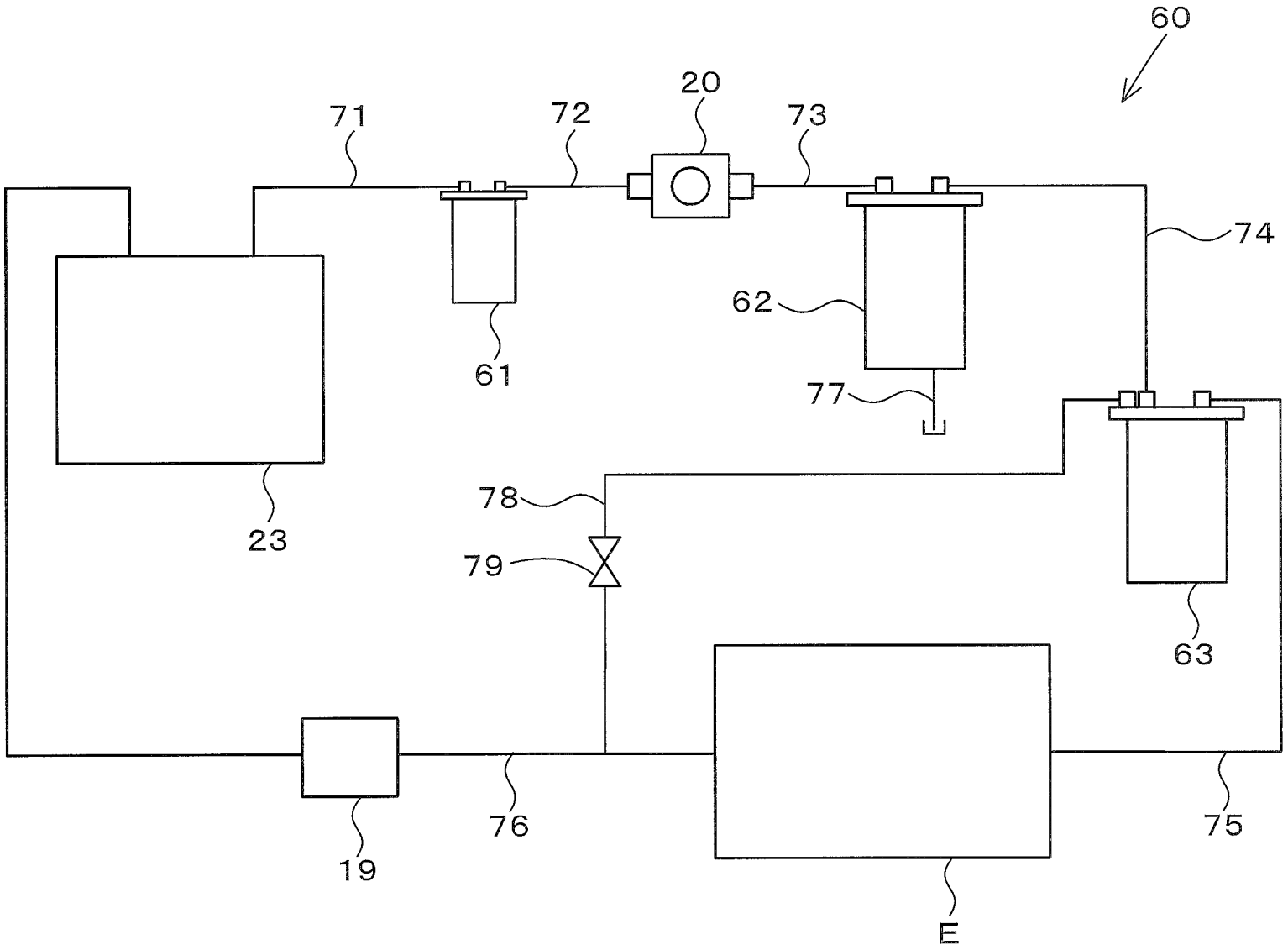
FIG. 8 is a view illustrating a system of a fuel oil filtration device according to the first embodiment.

As shown in FIG. 8, FIG. 17, and the like, the work machine 1 according to the embodiment includes the fuel filtration device 60. The fuel filtration device 60 removes impurities included in the fuel oil that is to be supplied to the engine E. The fuel filtration device 60 includes the first filter 61, the second filter 62, and the third filter 63.

The first filter 61 is a sedimenter to remove water included in the fuel oil that is to be supplied to the engine E. An inlet of the first filter 61 is connected to the tank (the fuel tank) 23 by a first fluid tube (a first fluid path) 71. An outlet of the first filter 61 is connected to a suction port of the pump (the fuel pump) 20 by a second fluid tube (a second fluid path) 72.

The first filter 61 separates the water included in the fuel oil from the fuel oil due to a difference between a specific weight of the water and a specific weight of the fuel oil, the fuel oil being to be supplied from the fuel tank 23 to the engine E. In addition, the first filter 61 may have a function to remove a foreign substance and the like included in the fuel oil.

The second filter 62 is a filter of a filtration type (a screen type). The second filter 62 removes the water and the impurities (the foreign substance such as particulates) both included in the fuel oil that is to be supplied to the engine E. An inlet of the second filter 62 is connected to an output port of the fuel pump 20 by a third fluid tube (a third fluid path) 73.

An outlet of the second filter 62 is connected to the third filter 63 by a fourth fluid tube (a fourth fluid path) 74. The fluid pump 20 sucks the fuel oil that passes through the first filter 61 and supplies the fuel oil to the second fluid tube 72, and then outputs the fuel oil to the third fluid tube 73.

Figure 5:
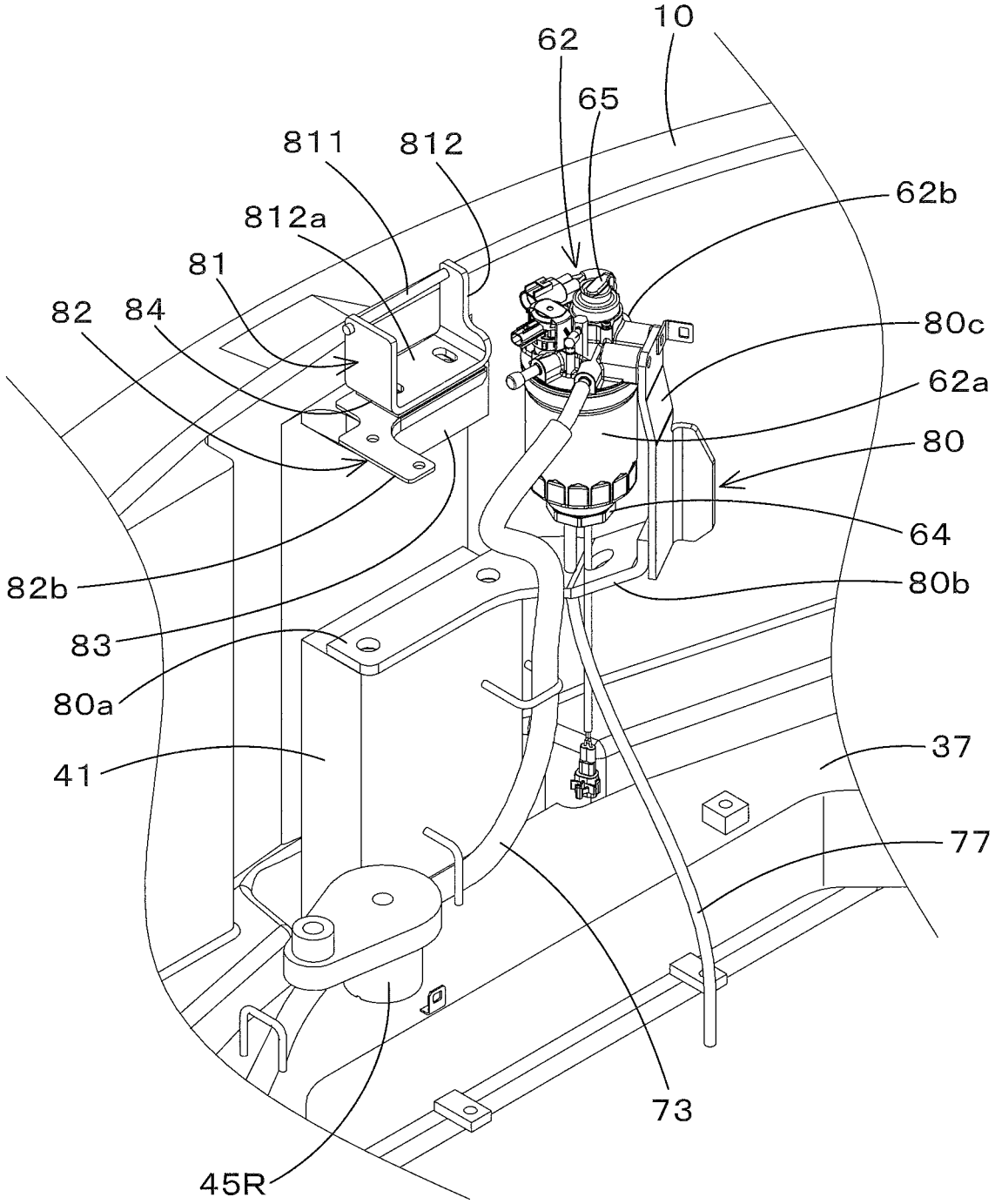
FIG. 5 is a view illustrating a configuration omitting the third filter from the configuration illustrated in FIG. 2 according to the first embodiment.

The second filter 62 filtrates the fuel oil that is outputted from the fuel pump 20 to the third fluid tube 73, and then supplies the fuel oil to the fourth fluid tube 74. As shown in FIG. 5 and the like, the second filter 62 includes a main body, a water detection sensor 64, and a heater 65. The main body includes a housing 62*a* and a lid member 62*b*.

The housing 62*a* has a cylindrical shape having an opening upper surface. A filter element (a filtration member) is housed in the housing 62*a*. The filter element catches the impurities (the foreign substance such as particulates) included in the fuel oil. A water drain tube (a water drain path) 77 is connected to a lower portion of the housing 62*a*.

The lid 62*b* is attached to an upper portion of the housing 62*a* so as to close the upper surface of the housing 62*a*. The lid 62*b* has an inlet port and an outlet port. The inlet port of the lid 62*b* is connected to the third fluid tube 73. The outlet port of the lid 62*b* is connected to the fourth fluid tube 74.

The water detection sensor 64 is attached to a lower portion of the housing 62*a*. The water detection sensor 64 detects the water included in the fuel oil. In particular, the water detection sensor 64 detects the water collected in the lower portion of the housing 62*a*, the water being separated from the fuel oil due to a difference between a specific weight of the water and a specific weight of the fuel oil.

The water collected in the lower portion of the housing 62*a* is detected by the water detection sensor 64, and can be manually discharged to a drain through the water drain tube 77. In this manner, when the first filter 61 does not remove the water sufficiently, the second filter 62 separates the water included in the fuel oil, detects an amount the water separated from the fuel oil, removes the water as needed, and then supplies the fuel oil to the third filter 63.

In this manner, the fuel oil including little amount of the water can be supplied to the engine E.

The heater 65 is activated when a temperature of the fuel oil is a predetermined temperature or less, and thus warms the fuel oil. In this manner, the fuel oil is prevented from being turned into a wax state (being solidified), and thus the third filter 63 is prevented from being filled with the fuel oil solidified as mentioned above even when the third filter 63 employs a filter having a filtration fineness higher than the filtration fineness of the second filter 62 as described below. Thus, the fuel oil can be supplied to the engine E adequately.

The third filter 63 is a filter of a filtration type (a screen type) as with the second filter 62. The third filter 63 removes the impurities (the foreign substance such as particulates) included in the fuel oil that is to be supplied to the engine E. The third filter 63 filtrates the fuel oil that is outputted to the fourth fluid tube 74 after passing through the second filter 62, and then outputs the fuel oil to a fifth fluid tube (a fifth fluid path) 75.

An inlet of the third filter 63 is connected to an outlet of the second filter 62 by the fourth fluid tube 74. An outlet of the third filter 63 is connected to the engine E by the fifth fluid tube 75.

Figure 6:
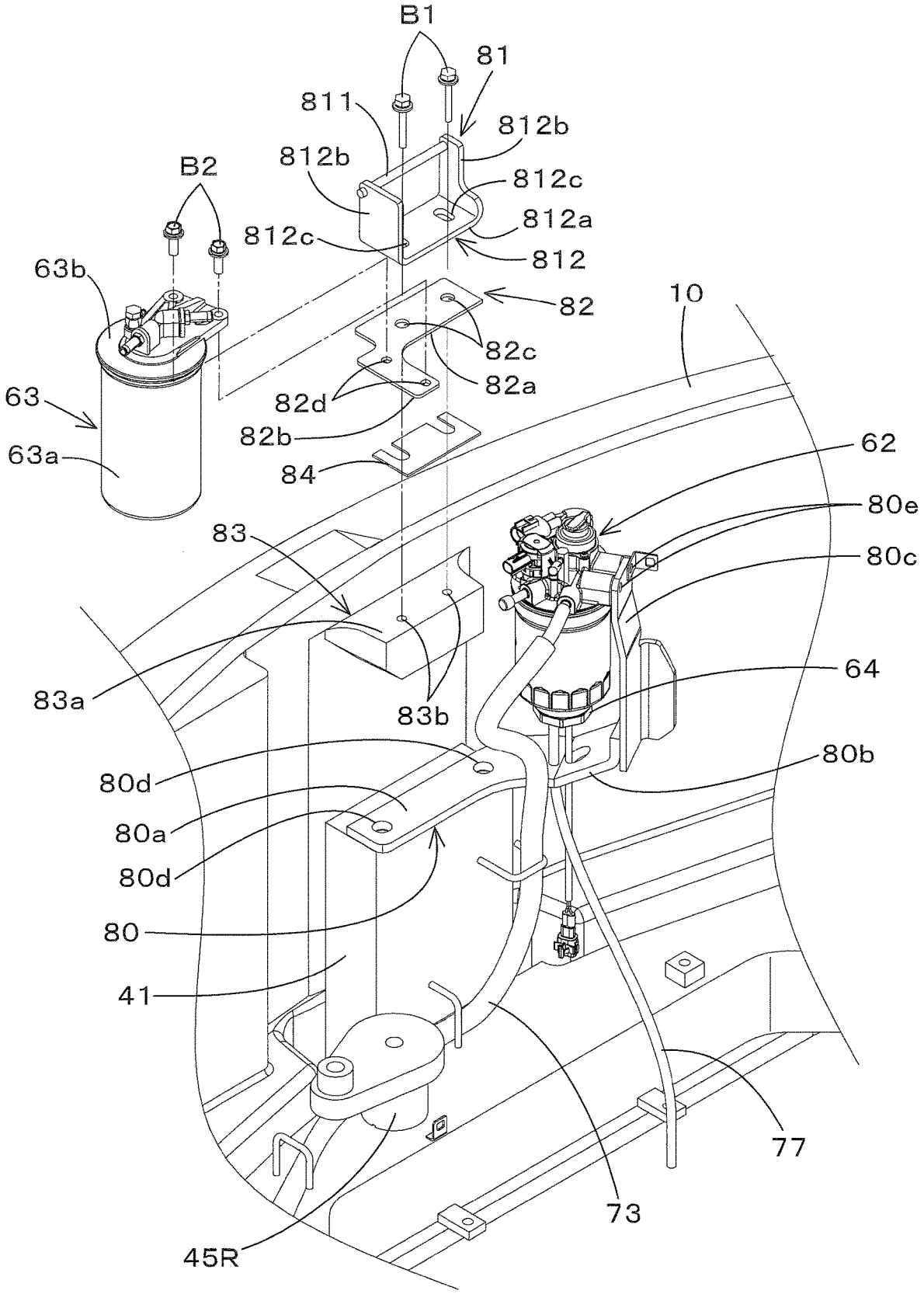
FIG. 6 is a perspective view developing the configuration illustrated in FIG. 2 according to the first embodiment.

As shown in FIG. 6, the third filter 63 includes a housing 63*a* and a lid member 63*b*. The housing 63*a* has a cylindrical shape having an opening upper surface. A filter element (a filtration member) is housed in the housing 63*a*. The filter element catches the impurities (the foreign substance such as particulates) included in the fuel oil.

The lid 63*b* has an inlet port and an outlet port. The inlet port of the lid 63*b* is connected to the fourth fluid tube 74. The outlet port of the lid 63*b* is connected to the fifth fluid tube 75. In addition, an air release tube 78 is connected to the lid 63*b*.

The third filter 63 has a filtration fineness higher than the filtration fineness of the second filter 62. In other words, the third filter 63 includes a filter element having a mesh size smaller than a mesh size of a filter element of the second filter 62. That is, in the embodiment, the filtration fineness is defined depending on the mesh size. However, the types of the filter elements of the second filter 62 and the third filter 63 are not limited to a specific type.

In addition, the third filter 63 has a filtration area larger than a filtration area of the second filter 63. In this manner, the third filter 63 catches the impurities (the foreign substance such as particulates) that passes through the second filter 62 (that is not caught by the second filter 62). A capacity of the third filter 63 (a capacity of the housing 63*a*) may be set to be larger than a capacity of the second filter 62 (a capacity of the housing 62*a*).

In this manner, while the third filter 63 tends to be clogged due to the small mesh size, the third filter 63 having the large capacity can be exchanged in a cycle similar to a cycle of exchanging the second filter 62.

The second filter 62 and the third filter 63 both have the filtration fineness suppressing an amount of the impurities that are included in the fuel oil filtrated by the second filter 62 and the third filter 63 such that the amount of the impurities can be an allowable amount or less preliminarily determined for the common-rail engine E (for example, an allowable amount or less set on the basis of the specifications that is determined by an manufacturer of the common-rail engine E).

In this manner, the engine E receives the fuel oil having the high cleanness even in a case where the fuel oil filled in the fuel tank 23 has a relatively-low cleanness for example. In particular, the common-rail type engine tends to cause a trouble where the common rail is clogged by the impurities included in the fuel oil, and thus it is required to supply the fuel oil having the high cleanness with respect to the engines of other types. However, the second filter 62 and the third filter 63 according to the embodiment keep the high cleanness of the fuel oil that is to be supplied to the engine E, thereby preventing the troubles mentioned above.

Meanwhile, in a case where the fuel oil filled in the fuel tank 23 has a relatively-high cleanness, the second filter 62 and the third filter 63 each are solely capable of suppressing the amount of the impurities such that the amount of the impurities can be an allowable amount or less preliminarily determined for the common-rail engine E, the impurities being included in the fuel oil filtrated by the second filter 62 or the third filter 63.

Thus, the work machine 1 may employ both the second filter 62 and the third filter 63 and may employ only the second filter 62 without employing the third filter 63 on the basis of the cleanness and the like of the fuel oil distributed in a region where the work machine 1 is used.

Among the second filter 62 and the third filter 63, the third filter 63 is provided with an air release mechanism. That is, in the embodiment, the second filter 62 is not provided with the air release mechanism, but the third filter 63 is provided with the air release mechanism The air release mechanism removes air present in the fuel oil that flows into the third filter 63. As shown in FIG. 8, the air release mechanism includes an air release tube (an air release path) 78 and a valve 79. The air release tube 78 connects the third filter 63 to a sixth fluid tube (a sixth fluid path) 76 described below. The valve 79 is disposed on an intermediate portion of the air release tube 78.

In the embodiment, the third filter 63 is not provided with the water detection sensor and the heater. However, the third filter 63 may have a configuration having the water detection sensor and/or the heater similar to the water detection sensor and/or the heater of the second filter 62.

The sixth fluid tube 76 connects the fuel tank 23 to the engine E. The fuel oil cooler 19 is disposed on an intermediate portion of the sixth fluid tube 76. The fuel oil cooler 19 cools the fuel oil flowing in the sixth fluid tube 76. The fuel oil supplied from the engine E to the sixth fluid tube 76 is cooled by the fuel oil cooler 19, and then returns to the fuel tank 23.

The fuel oil returned to the fuel tank 23 is sucked by the fuel pump 20, and is supplied to the first filter 61 again through the first fluid tube 71.

The air release tube 78 is connected to an intermediate portion of the sixth fluid tube 76 (between the engine E and the fuel oil cooler 19). When the valve 79 of the air release mechanism is opened, the valve 79 releases the air present in the fuel oil to the sixth fluid tube 76 through the air release tube 78, the fuel oil flowing into the third filter 63.

The first fluid 71 to the sixth fluid tube 76, the water drain tube 77, and the air release tube 78 are constituted of tube materials such as hoses and pipes.

Filter Support Structure

Figure 3:
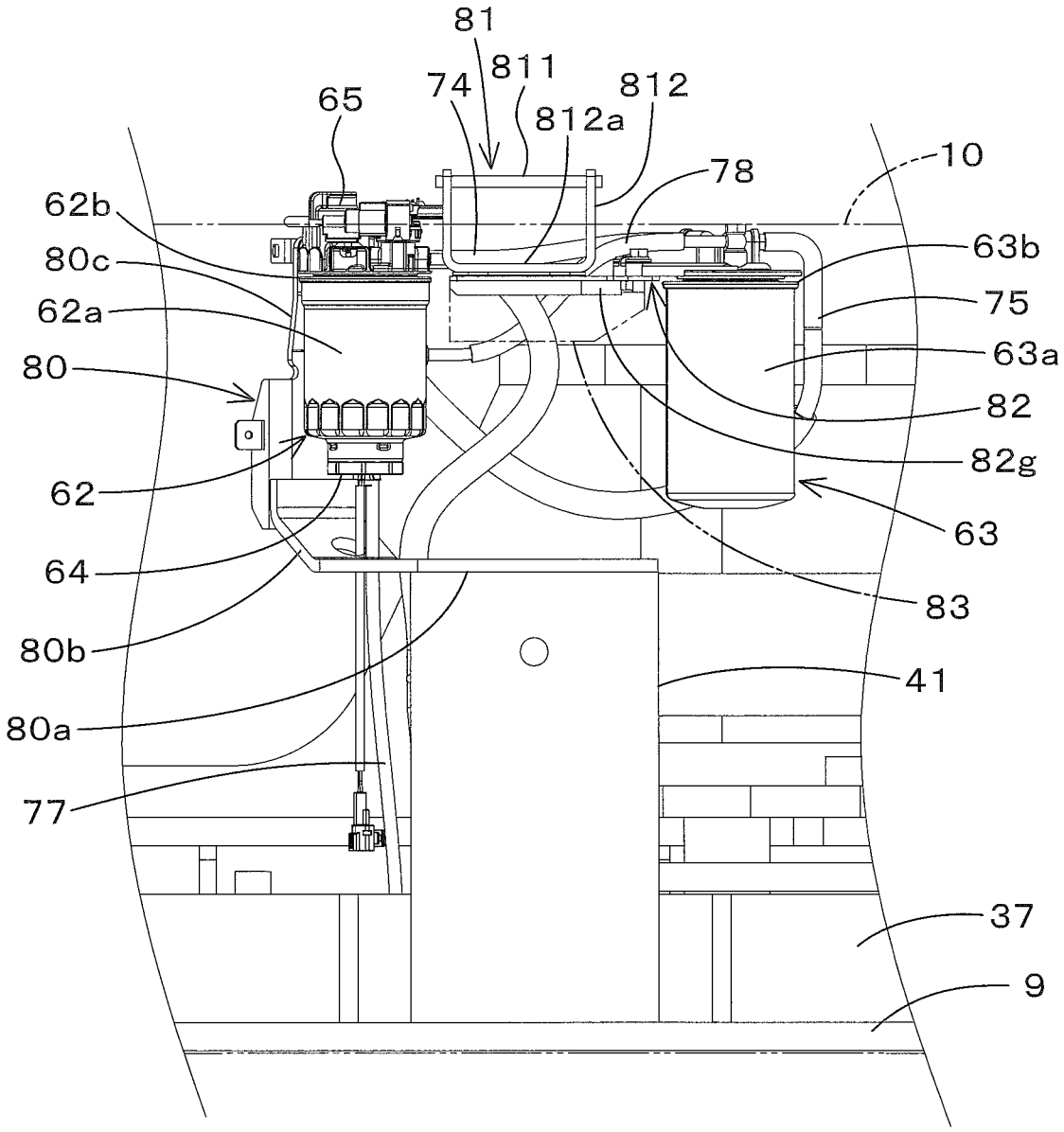
FIG. 3 is a back view illustrating the portion around the second filter and the third filter of the work machine according to the first embodiment.

As shown in FIG. 17, the second filter 62 and the third filter 63 are arranged in the rear portion of the engine room ER (arranged behind the engine E). Referring to FIG. 2 to FIG. 7, support structures for the second filter 62 and the third filter 63 will be explained below. FIG. 3 illustrates the weight 10 using the vertical lines (the two-dot chain lines).

The second filter 62 is supported by a support bracket 80. As shown in FIG. 5 and FIG. 6, the support bracket 80 includes a fixing portion 80*a*, an extending portion 80*b*, and a supporting portion 80*c*.

The fixing portion 80*a* has a plate shape and includes a through hole 80*d*. The fixing portion 80*a* is fixed to an upper surface of the rear support member 41 by a bolt (not shown in the drawings) inserted into the through hole 80*d*. The extending portion 80*b* is extended forward and leftward from the left end of the fixing portion 80*a*.

The extending portion 80*b* is provided with through holes through which the water drain tube 77 and wirings of the water detection sensor 64, the water drain tube 77 being connected to the second filter 62. The supporting portion 80*c* is extended upward from an end of the extension of the extending portion 80*b*. The supporting portion 80*c* is formed to have a plate shape, and is arranged facing one of the surfaces a right-forward direction and facing the other one of the surfaces in a right-backward direction.

An attachment hole 80*e* is disposed on an upper portion of the supporting portion 80*c*. The second filter 62 is attached to one side surface of the supporting portion 81*c* by a bolt (not shown in the drawings) inserted into the attachment hole 80*e*. The second filter 62 supported by the supporting bracket 80 is positioned leftward in front of an attachment portion 83 disposed on the weight 10.

The third filter 63 is supported by a support mechanism. The support mechanism includes the first bracket 81, a second bracket 82, and the attachment portion 83.

The first bracket 81 is a member configured to receive (latch) the bonnet 25 when the bonnet 25 is closed. As shown in FIG. 6 and the like, the first bracket 81 includes the receiving shaft 811 and a support member 812.

The receiving shaft 811 extends toward the machine width direction, and latches the latch 25*a* disposed on a rear lower portion of the bonnet 25. The latch 25*a* is latched to the receiving shaft 811 (the bonnet 25 is received by the first bracket 81) when the bonnet 25 is closed, and thereby the bonnet 25 is held under the closed state. Releasing the latching between the receiving shaft 811 and the latch 25*a* of the bonnet 25, the bonnet 25 can be opened upward.

The support member 812 includes a lower plate 812*a* and a side plate 812*b*. The lower plate 812*a* has a plurality of through holes 812*c* (two through holes 812*c*) arranged in the machine width direction. The side plate 812*b* stands up from one of edges (a right edge) of the lower plate 812*a* in the machine width direction. Another side plate 812*b* stands up from the other one of the edges (a left edge) of the lower plate 812*a* in the machine width direction. In this manner, the side plates 812*b* support both of end portions of the receiving shaft 811.

The attachment portion 83 is a portion to which the first bracket 81 is attached. The attachment portion 83 is disposed on a front surface of the weight 10 at a center of the weight 10 in the machine width direction, and the attachment portion 83 projects forward from an upper portion of the front surface.

As shown in FIG. 18, the attachment portion 83 is positioned behind the engine E. As shown in FIG. 6, the attachment portion 83 has an upper surface 83*a*. The upper surface 83*a* is substantially horizontal. And, the lower plate 812*a* of the first bracket 81 is attached to the upper surface 83*a*. The attachment portion 83 has an attachment hole (a screw hole) 83*b* that is formed downward from the upper surface 83*a* of the attachment portion 83.

The attachment portion 83 has a plurality of the attachment holes 83*b* (two attachment holes 83*b*) that are arranged at intervals in the machine width direction. The number of the attachment holes 83*b* and the intervals between the attachment holes 83*b* correspond to the number of the through holes 812*c* and intervals between the through holes 812*c*, the through holes 812*c* being disposed on the lower plate 812*a* of the first bracket 81.

The second bracket 82 is a member having a plate shape, and is configured to support the third filter 63. The second bracket 82 is attached to the attachment portion 83.

Figure 7A:
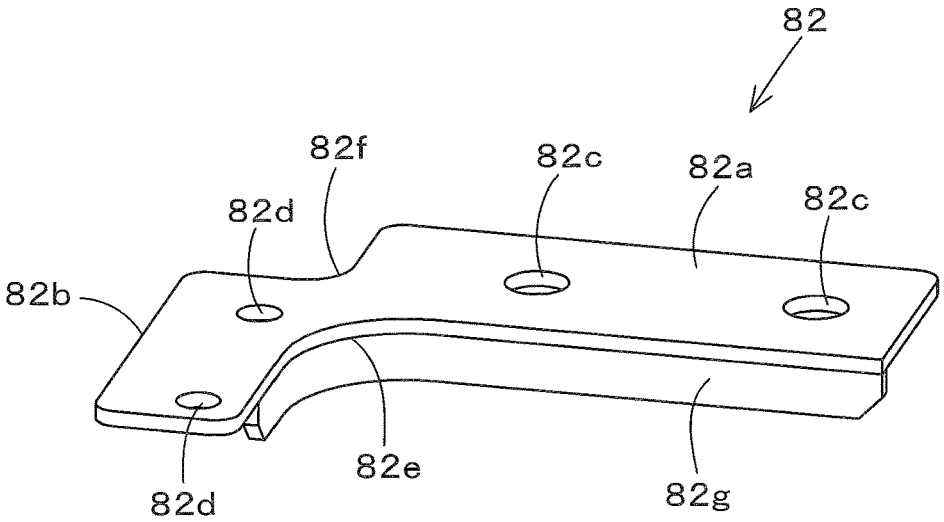
FIG. 7A is a perspective view illustrating a second bracket according to the first embodiment.
Figure 7B:
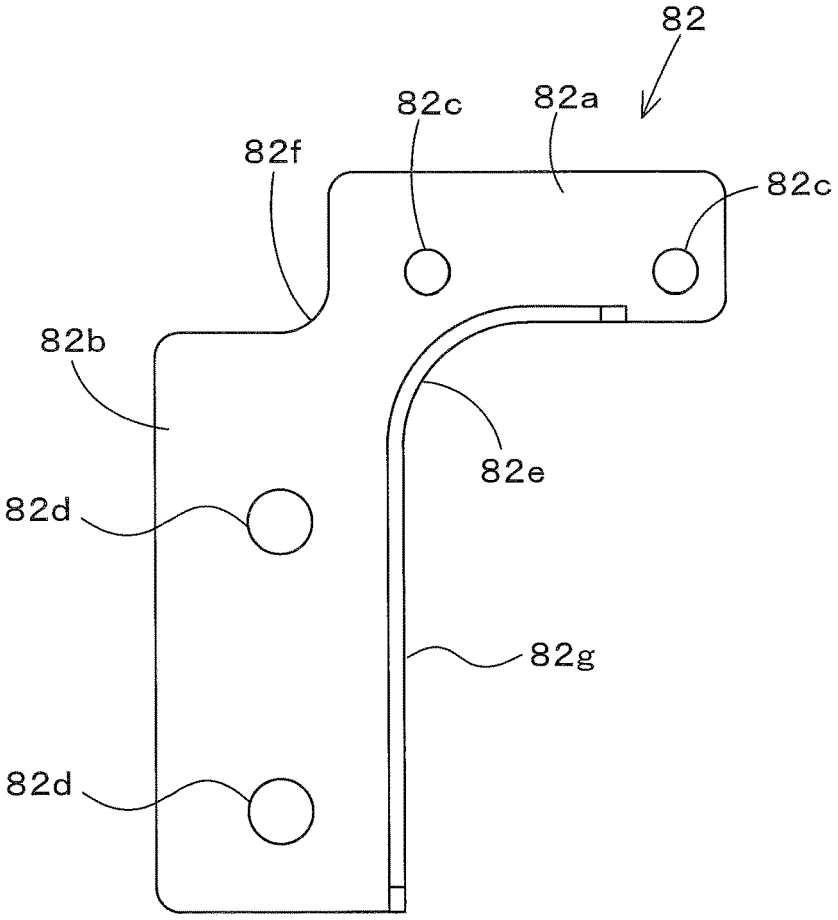
FIG. 7B is a bottom view illustrating the second bracket according to the first embodiment.

As shown in FIG. 6, FIG. 7A, and FIG. 7B, the second bracket 82 includes an intermediate portion 82*a* and a support portion 82*b*. The intermediate portion 82*a* has a substantially-rectangular shape in a plane view, the substantially-rectangular shape being elongated in the machine width direction. The intermediate portion 82*a* has a plurality of through holes 82*c* (two through holes 82*c*) arranged at intervals in the machine width direction. The support portion 82*b* has a substantially-rectangular shape in a plane view, the substantially-rectangular shape being elongated in the front to rear direction K1. The support portion 82*b* has a plurality of through holes 82*d* (two through holes 82*d*) arranged at intervals in the front to rear direction K1.

A nut (not shown in the drawings) is welded to a lower surface of the support portion 82*b* such that the nut is concentric with the through hole 82*d*. The intermediate portion 82*a* and the support portion 82*b* are connected to each other with a connection between one corner of the intermediate portion 82*a* and one corner of the support portion 82*b*. In this manner, the second bracket 82 has a substantially-L shape in a plane view as a whole.

In other words, the second bracket 82 has a shape removing two notched portions (a first notched portion 82*e* and a second notched portion 82*f*) from a rectangular shape in a plane view. The two notched portions are positioned on a diagonal line of the rectangular shape.

Figure 12:
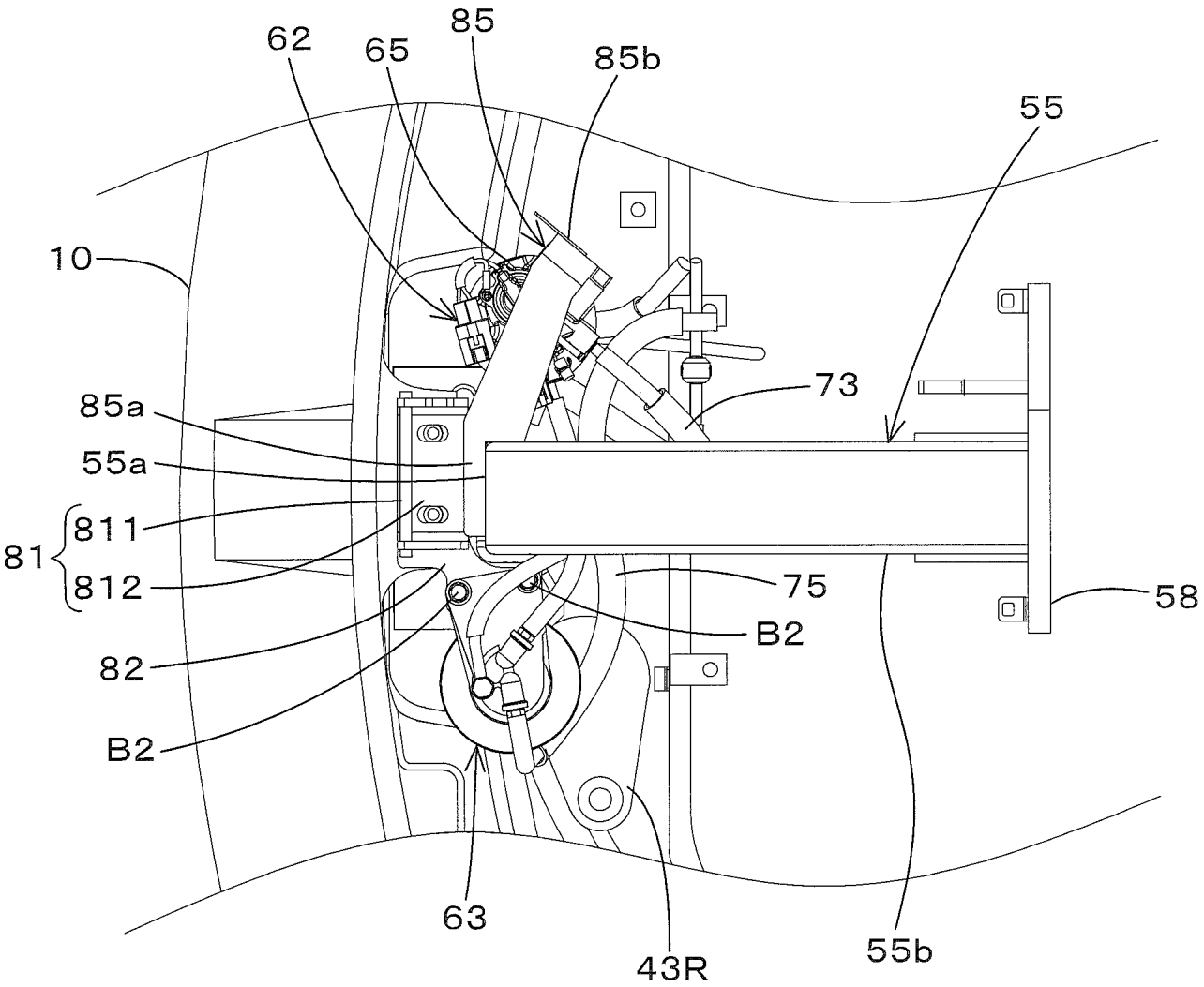
FIG. 12 is a plan view illustrating the portion around the second filter and the third filter of the work machine according to the second embodiment.

The first notched portion 82*e* is employed for preventing interference between a support member 55 and the second bracket 82 in a case where the work machine 1 according to the embodiment (the first embodiment) employs the support member 55 that is to be described in a second embodiment of the present invention (refer to FIG. 12).

The second notched portion 82*f* is employed for preventing interference between the second bracket 82 and a noise absorbing material such as a sponge (not shown in the drawings) attached to a front surface (an inner surface) of the weight 10.

As shown in FIG. 7A and FIG. 7B, a rib 82*g* is disposed on a lower surface of the second bracket 82 along an edge of one of the notched portions (an edge of the first notched portion 82*e*). The rib 82*g* is formed to have an L-shape extending from the intermediate portion 82*a* to the support portion 82*b* in a plane view.

To be detailed, the rib 82*g* is formed along the first notched portion 82*e* on a substantially full length (a half of length or more) of one of the longitudinal sides of the intermediate portion 82*a* and on a substantially full length (a half of length or more) of one of the longitudinal sides of the support portion 82*b*. The rib 82*g* protrudes downward.

The provision of the rib 82*g* improves the strength (the rigidity) of the second bracket 82. Thus, the thickness of the second bracket 82 can be reduced.

As shown in FIG. 6 and the like, the intermediate portion 82*a* is arranged between the upper surface 83*a* of the attachment portion 83 and the lower plate 812*a* of the first bracket 81. The through hole 82*c*, the through hole 812*c*, and the attachment hole 83*b* are overlapped each other when the intermediate portion 82*a* is arranged between the attachment portion 83 and the first bracket 81.

In this manner, when a fastening member (a bolt) B1 is inserted into the through hole 82*c* and the through hole 812*c* and then is screwed with attachment hole 83*b*, the intermediate portion 82*a* is attached being arranged (sandwiched) between the attachment portion 83 and the first bracket 81.

That is, the intermediate portion 82*a* is fastened to the attachment portion 83 together with the first bracket 81 by the fastening member (the bolt) B1, and is thereby attached to the attachment portion 83.

In this manner, the second bracket 82 has a function of a shim (a spacer) for adjusting a clearance between the first bracket 81 and the attachment portion 83 in addition to a function of a bracket for supporting the third filter 63. The attachment hole 83*b* of the attachment portion 83 can be used for both of the attachment of the first bracket 81 and the attachment of the second bracket 82.

Thus, the attachment of the second bracket 82 requires no attachment hole other than the attachment hole 83*b*. However, the second bracket 82 may require an attachment hole other than the attachment hole 83*b* of the weight 10, which is a modified example of the embodiment.

In addition, a thin plate (a shim) 84 may be arranged between the intermediate portion 82*a* and the attachment portion 83, the thin plate 84 being employed for adjusting the clearance between the intermediate portion 82*a* and the attachment portion 83.

The support portion 82*b* is a portion for supporting the third filter 63. As shown in FIG. 5, the support portion 82*b* projects forward and rightward from the attachment portion 83 under the state where the intermediate portion 82*a* is attached to the attachment portion 83.

Figure 4:
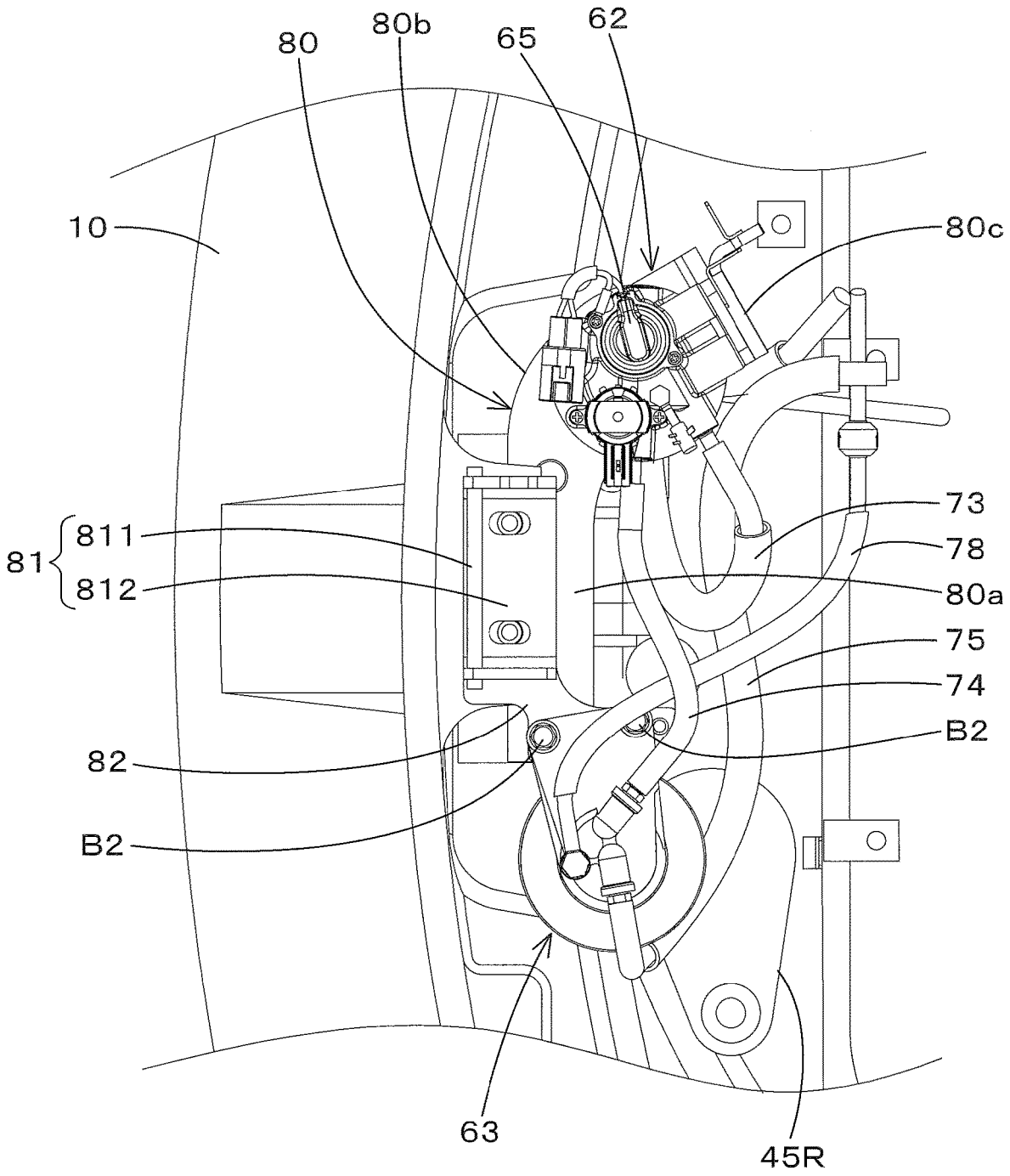
FIG. 4 is a plan view illustrating the portion around the second filter and the third filter of the work machine according to the first embodiment.

As shown in FIG. 6 and FIG. 4, a fastening member (a bolt) B2 is inserted into the through hole 82*d* of the support portion 82*b*. The bolt B2 is screwed into the nut disposed on a lower surface of the support portion 82*b*, and thereby the third filter 63 is attached to the support portion 82*b*. In this manner, the third filter 63 is supported by the second bracket 82 rightward in front of the attachment portion 83.

As shown in FIG. 3, the second bracket 82 supports the third filter 63 at a position where a connecting portion between the third filter 63 and the fourth fluid tube 74 (an upper surface of the housing 63*a*) can be positioned at a height substantially identical to a height of a connecting portion between the second filter 62 and the air release tube 78 (an upper surface of the housing 62*a*).

In this manner, the air can be prevented from staying in the second filter 62 without the air release mechanism employed in the second filter 62, and thus the air can be released adequately from the second filter 62 and the third filter 63.

In addition, it is possible to shorten a length of the hose (the fourth fluid tube 74) connecting the second filter 62 to the third filter 63. Moreover, the fuel oil can be supplied smoothly in comparison with the smoothness of a case where the height of the second filter 62 is largely different from the height of the third filter 63 is large.

The filter support structure described in the above-mentioned embodiment (the first embodiment) arranges the second filter 62 on one of the sides of (leftward in front of) the attachment portion 83 and arranges the third filter 63 on the other one of the sides of (rightward in front of) the attachment portion 83.

That is, the second filter 62 and the third filter 63 are arranged adjacent to each other across the attachment portion 83 in the machine width direction. In this manner, a size of the filter support structure can be reduced, thereby increasing largely a space for installing the engine E.

In addition, when the bonnet 25 is opened, the second filter 62 and the third filter 63 can be easily accessed, and thus the easy access makes the maintenance operations easy, for example, replacement of the filter element.

Second Embodiment

Referring to FIG. 9 to FIG. 13, a second embodiment of the present invention (the work machine 1) will be explained below. The second embodiment mainly explains configurations different from the configurations of the first embodiment described above. The explanation of the configurations similar to the configurations of the first embodiment will be omitted except the configurations especially required to be explained.

Figure 9:
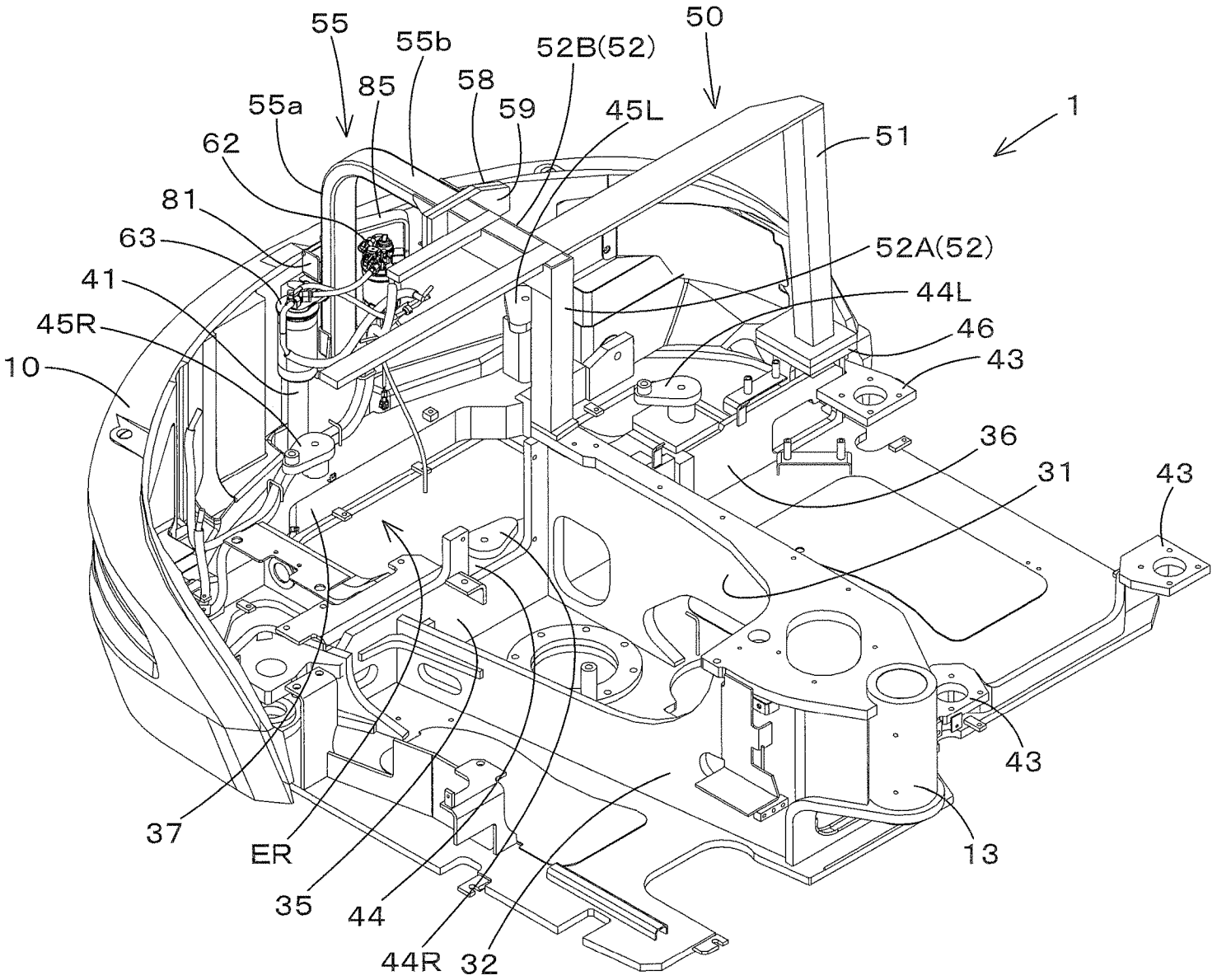
FIG. 9 is a perspective view illustrating a major configuration (a base plate, a weight, a second filter, a third filter, and the like) of a work machine according to a second embodiment of the present invention.
Figure 10:
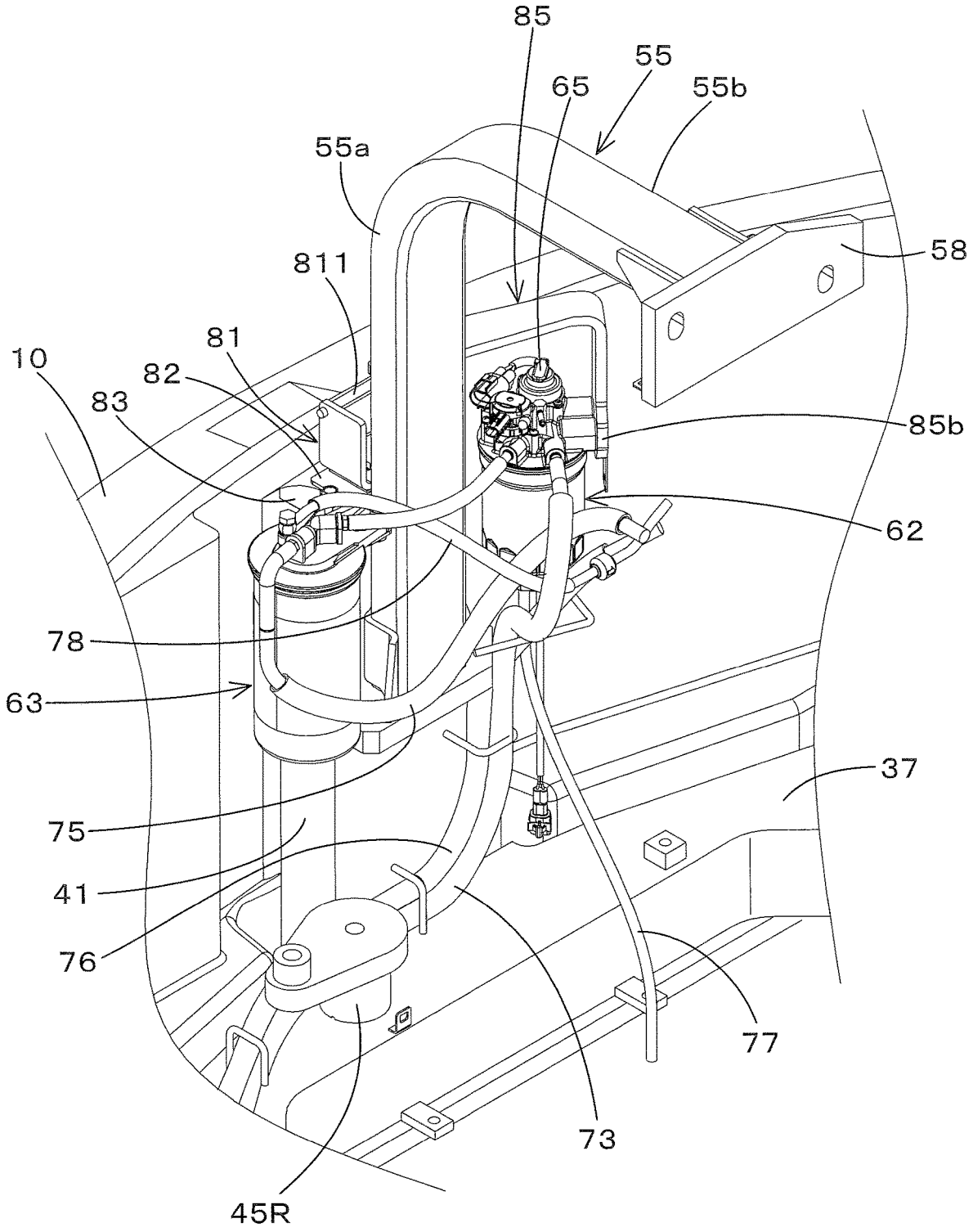
FIG. 10 is a perspective view illustrating a portion around the second filter and the third filter of the work machine according to the second embodiment.

As shown in FIG. 9, the work machine 1 according to the second embodiment includes the support frame 50 having a support member (a reinforcement leg) 55 in addition to the first leg 51, the second leg 52, the first support portion 53, and the second support portion 54. The support member 55 supports the support frame 50 from behind, and thereby reinforces the support frame 50. The support member 55 supports the bonnet 25 from below.

The support member (the reinforcement leg) 55 stands on the rear portion of the engine room ER. In particular, the support member 55 includes a rear leg portion 55*a* and a forward-extending portion 55*b*. The rear leg portion 55*a* is fixed to an upper surface of the rear support member 41 by a bolt, and extends upward from the upper surface.

The forward-extending portion 55*b* is curved from an upper portion of the rear leg portion 55*a*, and then passes above the engine E and extends forward to the support frame 50. A first connection plate 58 is disposed on a front end of the forward-extending portion 55*b*.

In addition, a second connection plate 59 is disposed on a rear end of the second leg 52 (the communicating portion 52B) of the support frame 50. The first connection plate 58 and the second connection plate 59 are connected to each other by a fastening member such as a bolt.

In this manner, the support member 55 is attached to the rear portion of the support frame 50, and thus the support frame 50 is reinforced by the support member 55. The support member 55 may be preliminarily attached to the support frame 50 as shown in FIG. 9, and may be attached later to the support frame 50 of a work machine (the work machine 1 according to the first embodiment and the like) that does not have the support member 55.

Figure 11:
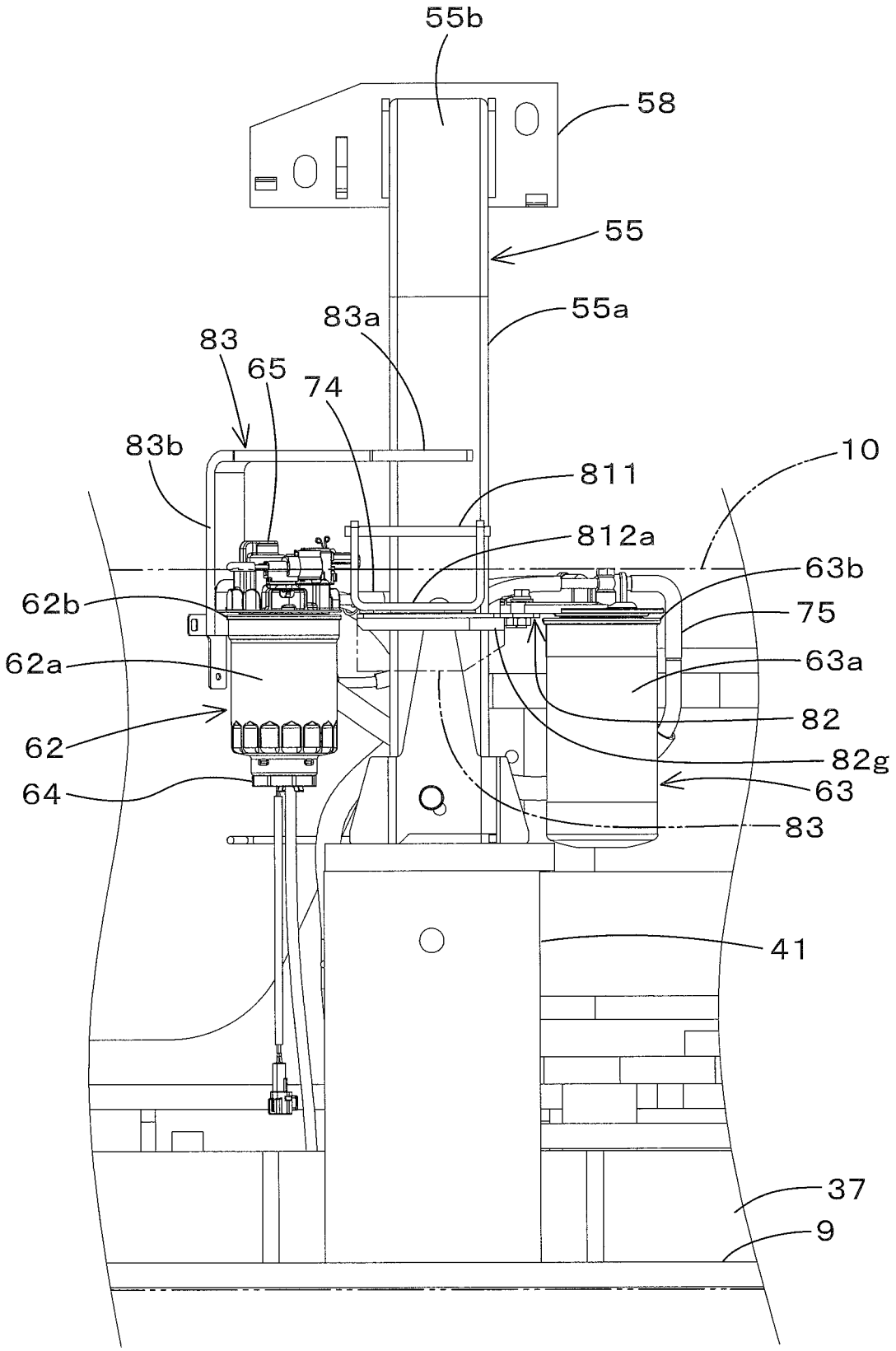
FIG. 11 is a back view illustrating the portion around the second filter and the third filter of the work machine according to the second embodiment.

The second filter 62 is supported by the third bracket 85. As shown in FIG. 11, FIG. 12, and the like, the third bracket 85 is formed of a strip-shaped flat plate that is bent to have an L-shape. The third bracket 85 includes a fixation portion 85*a* and a support portion 85*b*.

The fixation portion 85*a* is fixed to the rear leg portion 55*a* of the support member 55 by the welding. The fixation portion 85*a* extends forward and leftward from the rear leg portion 55*a*. The support portion 85*b* extends downward from an end of the extension of the fixation portion 85*a*.

The support portion 85*b* is arranged facing one of the surfaces a left-forward direction and facing the other one of the surfaces a right-backward direction. An attachment hole is disposed on a lower portion of the support portion 85*b*. The second filter 62 is attached to one of side surfaces of the support portion 80*b* by a bolt inserted into the attachment hole of the support portion 85*b*. In this manner, the second filter 62 is supported by the third bracket 85 on the left of the rear leg portion 55*a*.

The support mechanism for the third filter 63 is similar to the support mechanism of the third filter 63 according to the first embodiment mentioned above. In particular, the support mechanism for the third filter 63 includes the first bracket 81, the second bracket 82, and the attachment portion 83 that are similar to those of the support mechanism according to the first embodiment. The third filter 63 is supported by the second bracket 82 on the right of the rear leg portion 55*a*.

Figure 13:
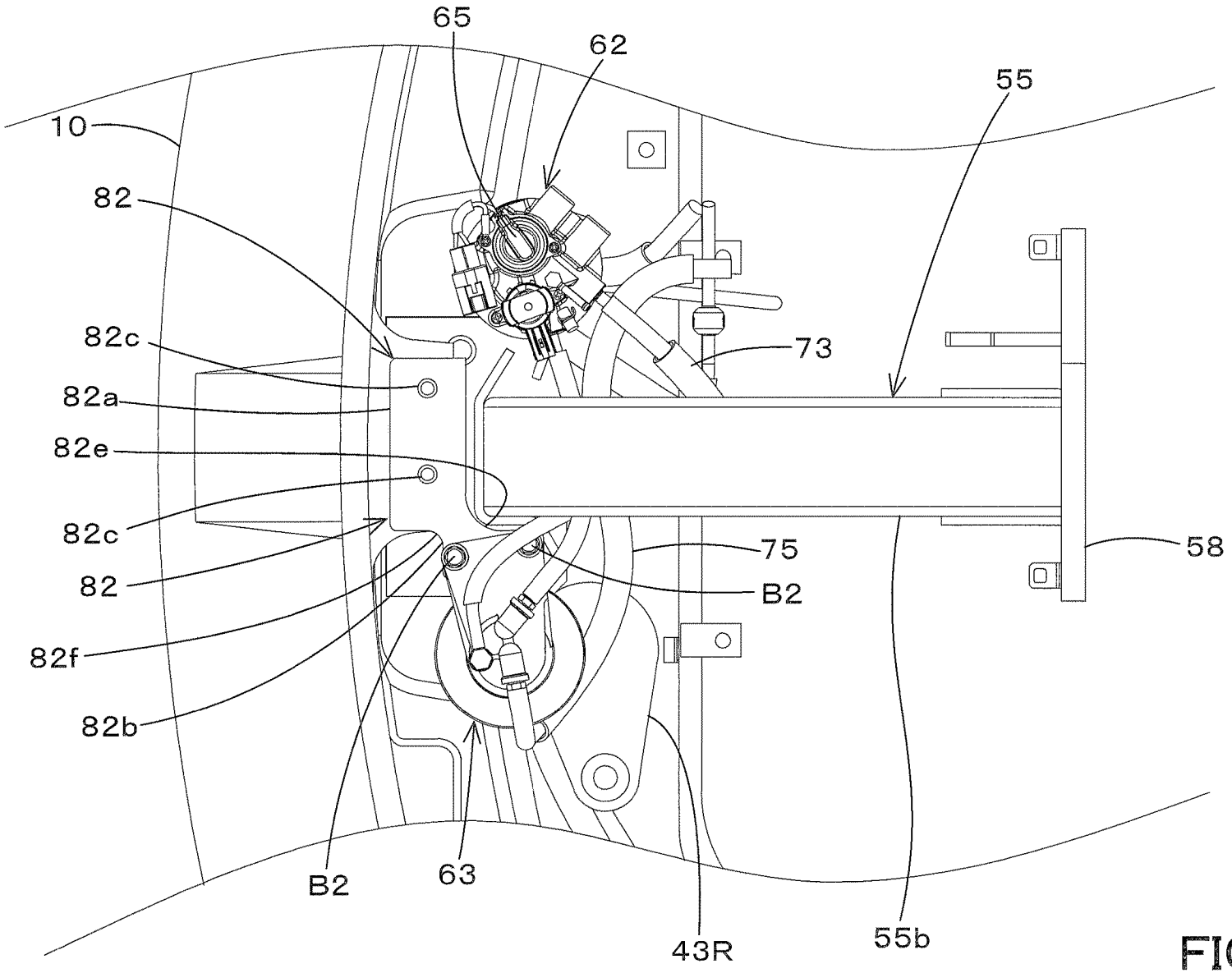
FIG. 13 is a view illustrating a configuration omitting the third filter from the configuration illustrated in FIG. 12 according to the second embodiment.

In the second embodiment, an edge of one of the notched portions (the first notched portion 82*e*) of the second bracket 82 extends along an outer surface (a rear surface and a right surface) of the rear leg portion 55*a* of the support member 55 as shown in FIG. 13. In particular, the second bracket 82 has an edge (the edge of the first notched portion 82*e*) formed by being notched to have a shape corresponding to an outer surface of the rear leg portion 55*a* along the outer surface of the rear leg portion 55*a* of the support member 55.

The second bracket 82 is arranged such that the first notched portion 82*e* is opposed to the outer surface of the support member 55 at a predetermined interval. In this manner, the rear leg portion 55*a* of the support member 55 can be prevented from interference with the second bracket 82. Thus, the second bracket 82 does not interfere with the attachment of the support member 55 in a case where the support member 55 is attached for the reinforcement to a work machine (for example, the work machine 1 according to the first embodiment) that does not have the support member 55.

In addition, the rib 82*g* is disposed along an edge of one of the notched portions (the first notched portion 82*e*) as in the first embodiment mentioned above. In this manner, even when the second bracket 82 forms the notched portion, the second bracket 82 is prevented from decreasing the strength of the second bracket 82.

As shown in FIG. 11, the second bracket 82 supports the third filter 63 at a position where a connecting portion between the third filter 63 and the fourth fluid tube 74 (an upper surface of the housing 63*a*) can be positioned at a height substantially identical to a height of a connecting portion between the second filter 62 and the air release tube 78 (an upper surface of the housing 62*a*).

In this manner, the air can be prevented from staying in the second filter 62 without the air release mechanism employed in the second filter 62, and thus the air can be released adequately from the second filter 62 and the third filter 63.

In addition, it is possible to shorten a length of the hose (the fourth fluid tube 74) connecting the second filter 62 to the third filter 63. Moreover, the fuel oil can be supplied smoothly in comparison with the smoothness of a case where the height of the second filter 62 is largely different from the height of the third filter 63 is large.

The filter support structure described in the above-mentioned embodiment (the second embodiment) arranges the second filter 62 on one of the sides of (on the left of) the support member 55 (the rear leg portion 55*a*) and arranges the third filter 63 on the other one of the sides of (on the right of) the support member 55 (the rear leg portion 55*a*).

That is, the second filter 62 and the third filter 63 are arranged adjacent to each other across the support member 55 (the rear leg portion 55*a*) in the machine width direction. In this manner, a size of the filter support structure can be reduced, thereby increasing largely a space for installing the engine E.

In addition, when the bonnet 25 is opened, the second filter 62 and the third filter 63 can be easily accessed, and thus the easy access makes the maintenance operations easy, for example, replacement of the filter element.

Third Embodiment

Figure 14:
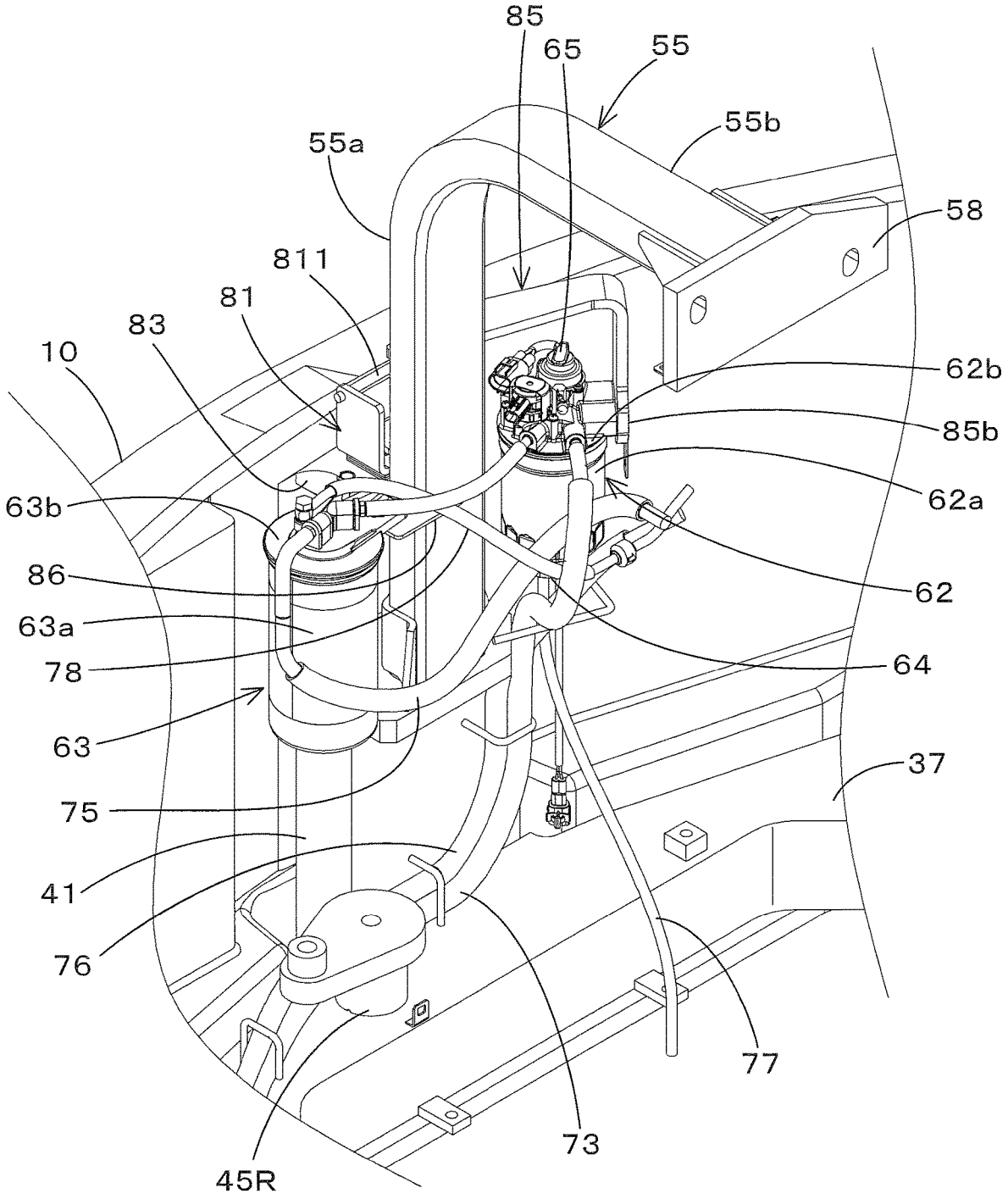
FIG. 14 is a perspective view illustrating a portion around a second filter and a third filter of the work machine according to a third embodiment of the present invention.
Figure 15:
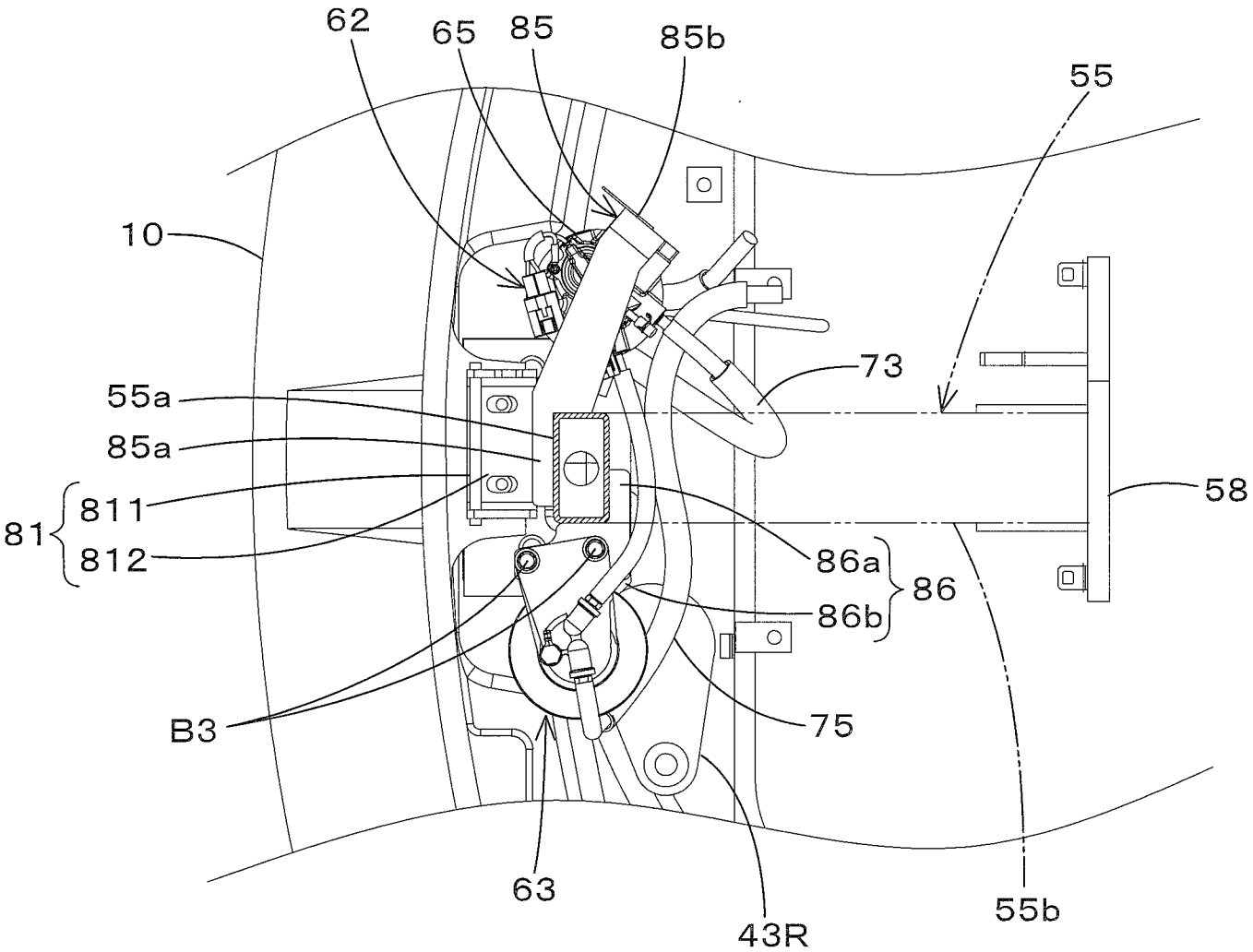
FIG. 15 is a plan view illustrating a partial cross-section of the portion around the second filter and the third filter of the work machine according to the third embodiment.

Referring to FIG. 14 and FIG. 15, a third embodiment of the present invention (the work machine 1) will be explained below. The third embodiment mainly explains configurations different from the configurations of the second embodiment described above. The explanation of the configurations similar to the configurations of the second embodiment will be omitted except the configurations especially required to be explained.

The work machine 1 according to the third embodiment has a support mechanism for the second filter 62, the support mechanism being similar to the support mechanism according to the second embodiment. The second filter 62 is supported by the third bracket 85 on the left of the rear leg portion 55*a* of the support member 55.

The work machine 1 according to the third embodiment has a support mechanism for the third filter 63 different from the support mechanisms according to the first embodiment and the second embodiment.

The third filter 63 is supported by the fourth bracket 86. The fourth bracket 86 is attached to a side of the support member 55, the side being opposite to the third bracket 85. In particular, the third bracket 85 is attached to one of the sides of (to the left of) the support member 55 (the rear leg portion 55*a*), and the fourth bracket 86 is attached to the other one of the sides of (to the right of) the support member 55 (the rear leg portion 55*a*).

The fourth bracket 86 has a flat plate shape, and includes a fixation portion 86*a* and a support portion 86*b*. The fixation portion 86*a* is fixed to an outer surface of the rear leg portion 55*a* of the support member 55 by the welding. The fourth bracket 86 extends backward and rightward from the rear leg portion 55*a*. The support portion 86*b* is arranged on the right of the rear leg portion 55*a*.

The support portion 86*b* is provided with an attachment hole. The third filter 63 is attached below the support portion 86*b* by a bolt B3 inserted into the attachment hole of the support portion 86*b*. In this manner, the third filter 63 is supported by the fourth bracket 86 on the right of the rear leg portion 55*a*.

The fourth bracket 86 supports the third filter 63 at a position where a connecting portion between the third filter 63 and the fourth fluid tube 74 (an upper surface of the housing 63*a*) can be positioned at a height substantially identical to a height of a connecting portion between the second filter 62 and the air release tube 78 (an upper surface of the housing 62*a*).

In this manner, the air can be prevented from staying in the second filter 62 without the air release mechanism employed in the second filter 62, and thus the air can be released adequately from the second filter 62 and the third filter 63.

In addition, it is possible to shorten a length of the hose (the fourth fluid tube 74) connecting the second filter 62 to the third filter 63. Moreover, the fuel oil can be supplied smoothly in comparison with the smoothness of a case where the height of the second filter 62 is largely different from the height of the third filter 63 is large.

The filter support structure described in the above-mentioned embodiment (the third embodiment) arranges the second filter 62 on one of the sides of (on the left of) the support member 55 (the rear leg portion 55*a*) and arranges the third filter 63 on the other one of the sides of (on the right of) the support member 55 (the rear leg portion 55*a*). That is, the second filter 62 and the third filter 63 are arranged adjacent to each other across the support member 55 (the rear leg portion 55*a*) in the machine width direction.

In this manner, a size of the filter support structure can be reduced, thereby increasing largely a space for installing the engine E. In addition, when the bonnet 25 is opened, the second filter 62 and the third filter 63 can be easily accessed, and thus the easy access makes the maintenance operations easy, for example, replacement of the filter element.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

Obviously, numerous modifications and variations of the present invention are possible in light of the above teachings. It is therefore to be understood that within the scope of the appended claims, the invention may be practiced otherwise than as specifically described herein.

What is claimed is:

1. A work machine comprising:
an engine;
a fluid path via which a fuel oil is supplied to the engine;
a first filter provided in the fluid path;
a pump provided between the engine and the first filter in the fluid path to suck and output the fuel oil;
a second filter provided between the engine and the pump in the fluid path; and
a third filter provided between the engine and the second filter in the fluid path,
wherein the second filter and the third filter are filters of filtration type to remove particulates included in the fuel oil,
wherein the third filter has a filtration fineness higher than a filtration fineness of the second filter and has a filtration area larger than a filtration area of the second filter,
wherein the first filter removes water included in the fuel oil, and
wherein the second filter separates, from the fuel oil, the water remaining in the fuel oil after filtration by the first filter and includes a water detection sensor to detect the water separated from the fuel oil.

2. The work machine according to claim 1,
wherein the engine is a common-rail engine.

3. The work machine according to claim 1,
wherein the second filter includes a heater to warm the fuel oil.

4. The work machine according to claim 1, comprising:
a tank to store the fuel oil;
a first fluid tube connecting the tank and the first filter;
a second fluid tube connecting the first filter and the pump;
a third fluid tube connecting the pump and the second filter;
a fourth fluid tube connecting the second filter and the third filter;
a fifth fluid tube connecting the third filter and the engine;
a sixth fluid tube connecting the engine and the tank; and
an air release mechanism connected to the third filter and including an air release tube connecting the third filter and the sixth fluid tube.

5. The work machine according to claim 4,
wherein a first connecting portion between the second filter and the fourth fluid tube is disposed substantially as high along a height of the work machine as a second connecting portion between the third filter and the air release tube.

6. The work machine according to claim 1, comprising:
a bonnet to cover an engine room in which the engine is installed, the bonnet being openable and closable;
a weight disposed behind the engine in a front-rear direction of the work machine;
a first bracket attached to the weight to catch the bonnet when the bonnet is closed; and
a second bracket attached to the weight to support the third filter.

7. The work machine according to claim 6,
wherein the weight includes an attachment portion to which the first bracket and the second bracket are attached, and
wherein the second bracket is tightened and attached to the attachment portion together with the first bracket by a tightening member.

8. The work machine according to claim 6, comprising:
a travel device;
a turn base plate turnably disposed on the travel device to mount the engine; and
a support member extending upward from the turn base plate to support the bonnet, the second bracket comprising:
an edge portion formed corresponding to an external surface of the support member; and
a rib provided along the edge portion.

9. The work machine according to claim 8,
wherein the second filter is disposed on a first side of the support member, and
wherein the third filter is disposed on a second side of the support member, the second side being opposite to the first side.

10. The work machine according to claim 1, comprising:
a travel device;
a turn base plate turnably disposed on the travel device to mount the engine;
a support member extending upward from the turn base plate to support the bonnet;
a third bracket disposed on a first side of the support member to support the second filter; and
a fourth bracket disposed on a second side of the support member to support the third filter, the second side being opposite to the first side.

* * * * *